US010957994B2

(12) United States Patent
Johnson et al.

(10) Patent No.: US 10,957,994 B2
(45) Date of Patent: Mar. 23, 2021

(54) WEDGE CONNECTOR ASSEMBLIES AND METHODS AND CONNECTIONS INCLUDING SAME

(71) Applicant: Tyco Electronics Canada ULC, Markham (CA)

(72) Inventors: Barry James Johnson, Vaughan (CA); Jonathan Guppy, Markham (CA); Sarzil Rahman, Scarborough (CA)

( * ) Notice: Subject to any disclaimer, the term of this patent is extended or adjusted under 35 U.S.C. 154(b) by 167 days.

(21) Appl. No.: 15/981,555

(22) Filed: May 16, 2018

(65) Prior Publication Data

US 2018/0342818 A1 Nov. 29, 2018

Related U.S. Application Data

(60) Provisional application No. 62/511,616, filed on May 26, 2017.

(51) Int. Cl.
*H01R 4/50* (2006.01)
*H01R 43/26* (2006.01)

(52) U.S. Cl.
CPC ..... *H01R 4/5083* (2013.01); *H01R 43/26* (2013.01); *H01R 4/5091* (2013.01)

(58) Field of Classification Search
CPC .... H01R 4/5083; H01R 43/26; Y10T 24/3973
USPC ..... 439/783
See application file for complete search history.

(56) References Cited

U.S. PATENT DOCUMENTS 3,275,974 A 9/1966 Mixon, Jr.
3,290,746 A 12/1966 Broske
3,345,454 A 10/1967 Mixon, Jr.
3,515,794 A 6/1970 Beinhaur et al.
(Continued)

FOREIGN PATENT DOCUMENTS

CA 2334187 8/2002
CN 1084320 A 3/1994
(Continued)

OTHER PUBLICATIONS

Notification of Transmittal of the International Search Report and the Written Opinion of the International Searching Authority, or the Declaration, in corresponding PCT Application No. PCT/CA2018/050600 (8 pages) (dated Aug. 2, 2018).
(Continued)

*Primary Examiner* — Livius R. Cazan

(57) ABSTRACT

A wedge connector system for connecting first and second elongate electrical conductors includes a C-shaped sleeve member, a wedge member, and an insert member. The sleeve member defines a sleeve cavity and opposed first and second sleeve channels on either side of the sleeve cavity. The wedge member includes a wedge body having first and second opposed wedge side walls. The insert member is configured to be selectively mounted in the first sleeve channel and defines an insert member channel to receive the first conductor when the insert member is mounted in the first sleeve channel. The sleeve member and the wedge member are configured to capture the first and second conductors such that: the first conductor is received in the insert member channel and captured between the sleeve member and the first wedge side wall; and the second conductor is captured between the sleeve member and the second wedge side wall.

21 Claims, 20 Drawing Sheets

(56) References Cited

U.S. PATENT DOCUMENTS

| | | | | |
|---|---|---|---|---|
| 3,681,512 | A | 8/1972 | Werner et al. | |
| 3,742,582 | A | 7/1973 | Broske | |
| 3,761,602 | A | 9/1973 | De Sio et al. | |
| 3,826,860 | A | 7/1974 | De Sio et al. | |
| 4,027,939 | A * | 6/1977 | White | H01R 4/5091 439/783 |
| 4,114,977 | A | 9/1978 | Polidori | |
| 4,252,992 | A | 2/1981 | Cherry et al. | |
| 4,279,461 | A | 7/1981 | Bussen et al. | |
| 4,415,222 | A | 11/1983 | Polidori | |
| 4,600,264 | A | 7/1986 | Counsel | |
| 4,722,189 | A | 2/1988 | Center | |
| 4,752,252 | A | 6/1988 | Cherry et al. | |
| 4,857,020 | A | 8/1989 | Crosby | |
| 4,863,403 | A | 9/1989 | Shannon | |
| RE33,098 | E | 10/1989 | Center | |
| 5,090,923 | A | 2/1992 | Kenyon et al. | |
| 5,092,797 | A | 3/1992 | Cole et al. | |
| 5,145,420 | A | 9/1992 | Counsel et al. | |
| 5,240,441 | A | 8/1993 | Laricchia et al. | |
| 5,244,422 | A | 9/1993 | Laricchia | |
| 5,305,669 | A * | 4/1994 | Kimbro | B25B 7/00 81/423 |
| 5,340,335 | A | 8/1994 | Haun | |
| 5,423,699 | A | 6/1995 | Johnson | |
| 5,538,447 | A | 7/1996 | Chadbourne et al. | |
| 5,558,546 | A | 9/1996 | Chadbourne et al. | |
| 5,600,096 | A | 2/1997 | Cherry et al. | |
| 5,683,273 | A | 11/1997 | Garver et al. | |
| 5,692,930 | A | 12/1997 | Garver et al. | |
| 5,774,987 | A | 7/1998 | Chadbourne et al. | |
| 5,794,334 | A | 8/1998 | Chadbourne et al. | |
| 5,862,589 | A | 1/1999 | Chadbourne et al. | |
| 5,911,604 | A * | 6/1999 | Chadbourne | H01R 4/2412 439/783 |
| 5,916,001 | A | 6/1999 | Chadbourne | |
| 6,093,064 | A | 7/2000 | Callen et al. | |
| 6,261,117 | B1 | 7/2001 | LaCroix | |
| 6,273,765 | B1 | 8/2001 | Lalaouna et al. | |
| 6,309,261 | B1 | 10/2001 | Chadbourne | |
| 6,817,909 | B2 | 11/2004 | Dobrinski et al. | |
| 6,851,262 | B1 | 2/2005 | Gregory et al. | |
| 6,895,663 | B2 | 5/2005 | Itrich | |
| 6,979,236 | B1 | 12/2005 | Stanton | |
| 6,996,987 | B2 | 2/2006 | Gregory et al. | |
| 7,182,653 | B1 | 2/2007 | Hoxha | |
| 7,309,263 | B2 | 12/2007 | Copper et al. | |
| 7,387,546 | B2 | 6/2008 | Copper et al. | |
| 7,426,782 | B2 | 9/2008 | Johnson et al. | |
| 7,494,385 | B2 | 2/2009 | Copper et al. | |
| 7,677,933 | B2 | 3/2010 | Copper et al. | |
| 7,686,661 | B2 | 3/2010 | Shrum et al. | |
| 7,707,693 | B2 | 5/2010 | Schaefer | |
| 7,736,203 | B2 | 6/2010 | Copper et al. | |
| 7,766,702 | B2 | 8/2010 | De France et al. | |
| 7,819,706 | B2 | 10/2010 | Copper et al. | |
| 7,845,990 | B2 | 12/2010 | Shrum et al. | |
| 7,862,390 | B2 | 1/2011 | Copper | |
| 7,997,943 | B2 | 8/2011 | Gregory et al. | |
| 8,176,625 | B2 | 5/2012 | Copper et al. | |
| 8,402,641 | B2 | 3/2013 | Johnson et al. | |
| 8,469,721 | B2 | 6/2013 | Mitchell et al. | |
| 8,550,842 | B1 | 10/2013 | Gutierrez et al. | |
| 8,608,517 | B2 | 12/2013 | La Salvia et al. | |
| 9,059,522 | B2 | 6/2015 | Spalding et al. | |
| 2003/0148671 | A1 | 8/2003 | Mello et al. | |
| 2004/0029455 | A1 | 2/2004 | Johnson et al. | |
| 2004/0203294 | A1 | 10/2004 | Mello et al. | |
| 2006/0148333 | A1 | 7/2006 | Peterson | |
| 2006/0148334 | A1 | 7/2006 | Conn et al. | |
| 2008/0026644 | A1 | 1/2008 | De France et al. | |
| 2010/0003864 | A1 | 1/2010 | Fuzetti et al. | |
| 2010/0151735 | A1 | 6/2010 | Crutcher et al. | |
| 2010/0314232 | A1 | 12/2010 | Gregory et al. | |
| 2013/0078873 | A1 | 3/2013 | La et al. | |
| 2018/0331435 | A1 | 11/2018 | Murugiah et al. | |

FOREIGN PATENT DOCUMENTS

| | | | |
|---|---|---|---|
| CN | 1198260 | A | 11/1998 |
| CN | 1243343 | A | 2/2002 |
| CN | 2634667 | Y | 8/2004 |
| CN | 102709720 | A | 10/2012 |
| EP | 0977311 | A2 | 2/2000 |
| WO | 00/01035 | | 1/2000 |
| WO | 2008/013891 | | 1/2008 |
| WO | 2013006546 | A1 | 1/2013 |

OTHER PUBLICATIONS

"Automatic connectors Reliable for wires, strands and conductors" Dribo, spol. s r.o. (4 pages) (Oct. 2003).

"U.D.C.—Universal Distribution Connector Reinforced" Tyco Electronics, Catalog 125003 (8 pages) (Mar. 1999).

AMPACT Taps, Stirrups, and Application Tooling, Customer Manual 409-2106 Rev M (39 pages) (Feb. 5, 1999).

Grupo Intelli General Catalog www.grupointelli.com IntMKT Set/2009 (52 pages) (Jan. 2009).

Tyco Electronics Energy Division Ready Reference Guide, retrieved from http://energy.tycoelectronics.com (143 pages) (Published at least as early as Sep. 2011).

Shear-Lok Grounding Connector data sheet, TE Connectivity (2 pages) (2014).

Wrench-Lok data sheet, TE Connectivity (2 pages) (2014).

Chinese Office Action corresponding to Chinese Application No. 201880048955.0 (Foreign Text, 17 pages; English Translation, 21 pages) (dated Aug. 31, 2020).

Extended European Search Report Corresponding to European Application No. 18806503.1 (10 pages) (dated Jan. 1, 2021).

* cited by examiner

WEDGE CONNECTOR ASSEMBLIES AND METHODS AND CONNECTIONS INCLUDING SAME

RELATED APPLICATION(S)

The present application claims the benefit of and priority from U.S. Provisional Patent Application No. 62/511,616, filed May 26, 2017, the disclosure of which is incorporated herein by reference in its entirety.

FIELD OF THE INVENTION

The present invention relates to electrical connectors and, more particularly, to power utility electrical connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, four types of connectors are commonly used for such purposes, namely bolt-on connectors, compression-type connectors, wedge connectors, and transverse wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors.

Compression connectors, instead of utilizing separate connector pieces, may include a single metal piece connector that is bent or deformed around the main power conductor and the tap conductor to clamp them to one another.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from TE Connectivity and is known as an AMPACT Tap or Stirrup Connector. AMPACT connectors include different sized channel members to accommodate a set range of conductor sizes, and multiple wedge sizes for each channel member. Each wedge accommodates a different conductor size.

Exemplary transverse wedge connectors are disclosed in U.S. Pat. Nos. 8,176,625, 7,997,943, 7,862,390, 7,845,990, 7,686,661, 7,677,933, 7,494,385, 7,387,546, 7,309,263, and 7,182,653.

SUMMARY OF THE INVENTION

According to some embodiments, a wedge connector system for connecting first and second elongate electrical conductors includes a C-shaped sleeve member, a wedge member, and an insert member. The sleeve member defines a sleeve cavity and opposed first and second sleeve channels on either side of the sleeve cavity. The wedge member includes a wedge body having first and second opposed wedge side walls. The insert member is configured to be selectively mounted in the first sleeve channel and defines an insert member channel to receive the first conductor when the insert member is mounted in the first sleeve channel. The sleeve member and the wedge member are configured to capture the first and second conductors such that: the first conductor is received in the insert member channel and captured between the sleeve member and the first wedge side wall; and the second conductor is captured between the sleeve member and the second wedge side wall.

According to some embodiments, a method for connecting first and second elongate electrical conductors includes providing a wedge connector system including: a C-shaped sleeve member defining a sleeve cavity and opposed first and second sleeve channels on either side of the sleeve cavity; a wedge member including a wedge body having first and second opposed wedge side walls; and an insert member configured to be selectively mounted in the first sleeve channel and defining an insert member channel to receive the first conductor when the insert member is mounted in the first sleeve channel. The method further includes placing the first conductor in the insert member channel with the insert member mounted in the first channel, and thereafter axially displacing the sleeve member and wedge member relative to one another to capture the first and second conductors such that: the first conductor is received in the insert member channel and captured between the sleeve member and the first wedge side wall; and the second conductor is captured between the sleeve member and the second wedge side wall.

According to some embodiments, a wedge connector system for connecting first and second elongate electrical conductors includes a C-shaped sleeve member, a wedge member, and an insert member. The sleeve member defines a sleeve cavity and opposed first and second sleeve channels on either side of the sleeve cavity. The wedge member includes a wedge body having first and second opposed wedge side walls. The insert member is configured to be selectively mounted on the first wedge side wall and defines an insert member channel to receive the first conductor when the insert member is mounted on the first wedge side wall. The sleeve member and the wedge member are configured to capture the first and second conductors such that: the first conductor is received in the insert member channel and captured between the sleeve member and the first wedge side wall; and the second conductor is captured between the sleeve member and the second wedge side wall.

According to some embodiments, a method for connecting first and second elongate electrical conductors includes providing a wedge connector system including: a C-shaped sleeve member defining a sleeve cavity and opposed first and second sleeve channels on either side of the sleeve cavity; a wedge member including a wedge body having first and second opposed wedge side walls; and an insert member configured to be selectively mounted on the first wedge side wall and defining an insert member channel to receive the first conductor when the insert member is mounted on the first wedge side wall. The method further includes placing the first conductor in the insert member channel with the insert member mounted on the first wedge side wall, and thereafter axially displacing the sleeve member and wedge member relative to one another to capture the first and second conductors such that: the first conductor is received in the insert member channel and captured between the sleeve member and the first wedge side wall; and the second conductor is captured between the sleeve member and the second wedge side wall.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
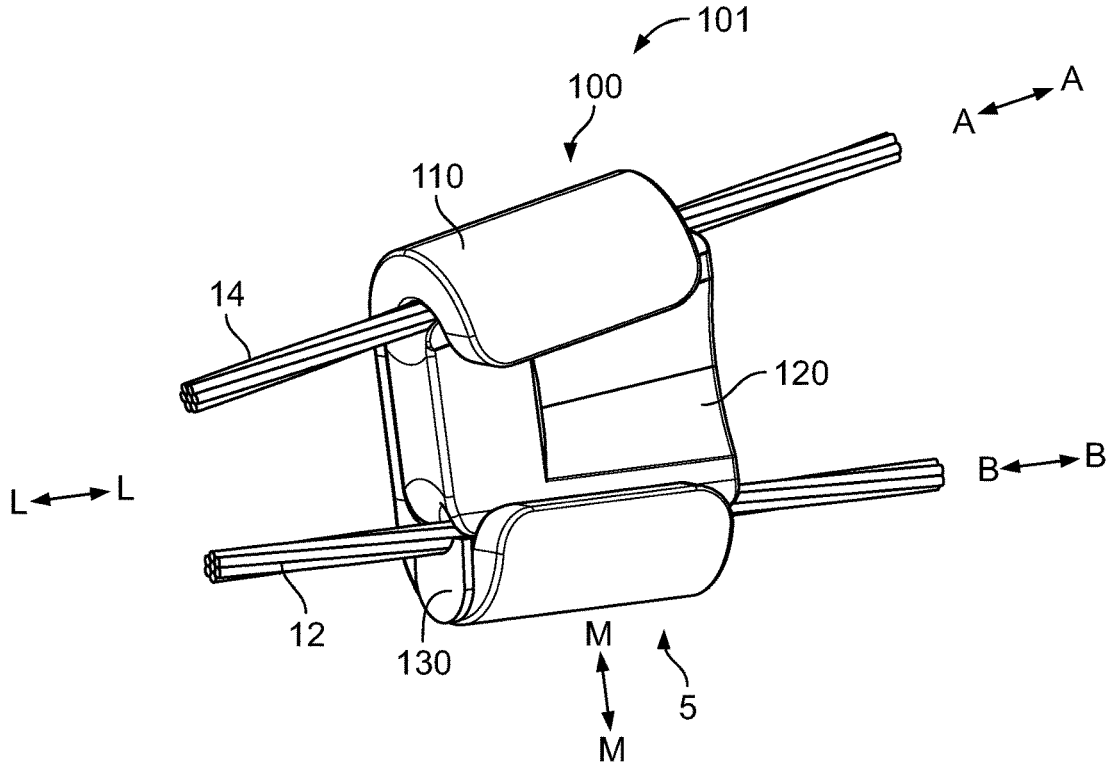
FIG. 1 is a front perspective view of a wedge connector system, and a wedge connector assembly and a connection formed thereby, according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-5, a wedge connector system or kit 101 and a wedge connector assembly 100 according to embodiments of the present invention is shown therein. The wedge connector system 101 can be used to form a connection 5 (FIGS. 1 and 2) including a pair of elongate electrical conductors 12, 14 (e.g., electrical power lines) mechanically and electrically coupled by the wedge connector assembly 100. The connector assembly 100 may be adapted for use as a tap connector for connecting an elongate tap conductor 12 to an elongate main conductor 14 of a utility power distribution system, for example.

The tap conductor 12, sometimes referred to as a distribution conductor, may be a known electrically conductive metal high voltage cable or line having a generally cylindrical form in an exemplary embodiment. The main conductor 14 may also be a generally cylindrical high voltage cable line. The tap conductor 12 and the main conductor 14 may be of the same wire gage or different wire gage in different applications and the connector assembly 100 is adapted to accommodate a range of wire gages for each of the tap conductor 12 and the main conductor 14. The conductor 12 has a lengthwise axis B-B and the conductor 14 has a lengthwise axis A-A.

When installed to the tap conductor 12 and the main conductor 14, the connector assembly 100 provides electrical connectivity between the main conductor 14 and the tap conductor 12 to feed electrical power from the main conductor 14 to the tap conductor 12 in, for example, an electrical utility power distribution system. The power distribution system may include a number of main conductors 14 of the same or different wire gage, and a number of tap conductors 12 of the same or different wire gage.

The conductors 12, 14 each include a plurality of separable elongate strands 12A, 14A. Alternatively, one of the conductors 12, 14 may be solid.

Figure 2:
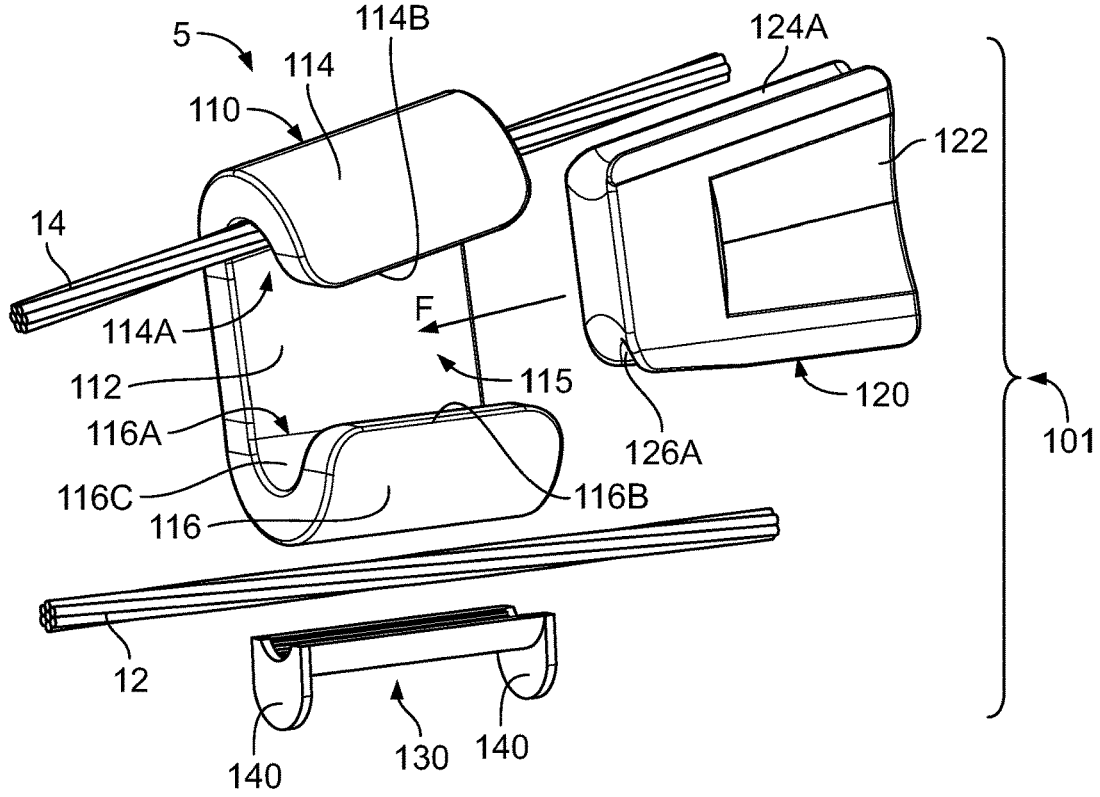
FIG. 2 is an exploded, front perspective view of the connection of FIG. 1.

As discussed below and as shown in FIGS. 1 and 2, the sections of the conductors 12, 14 extending through the wedge connector assembly 100 in the connection 5 are uninsulated and bare or exposed. In some embodiments, the conductors 12, 14 are uninsulated conductor cables.

With reference to FIG. 1, the wedge connector system 101, and the wedge connector assembly 100 formed therefrom, include a C-shaped channel or sleeve member 110, a wedge member 120, and an insert member 130. The sleeve member 110 and the wedge member 120 are movable relative to one another to cooperatively mechanically capture the conductors 12, 14 therebetween and electrically connect the conductors 12, 14 to one another.

With reference to FIG. 1, the assembled connector assembly 100 has a lengthwise axis L-L and a transverse axis M-M.

Figure 4:
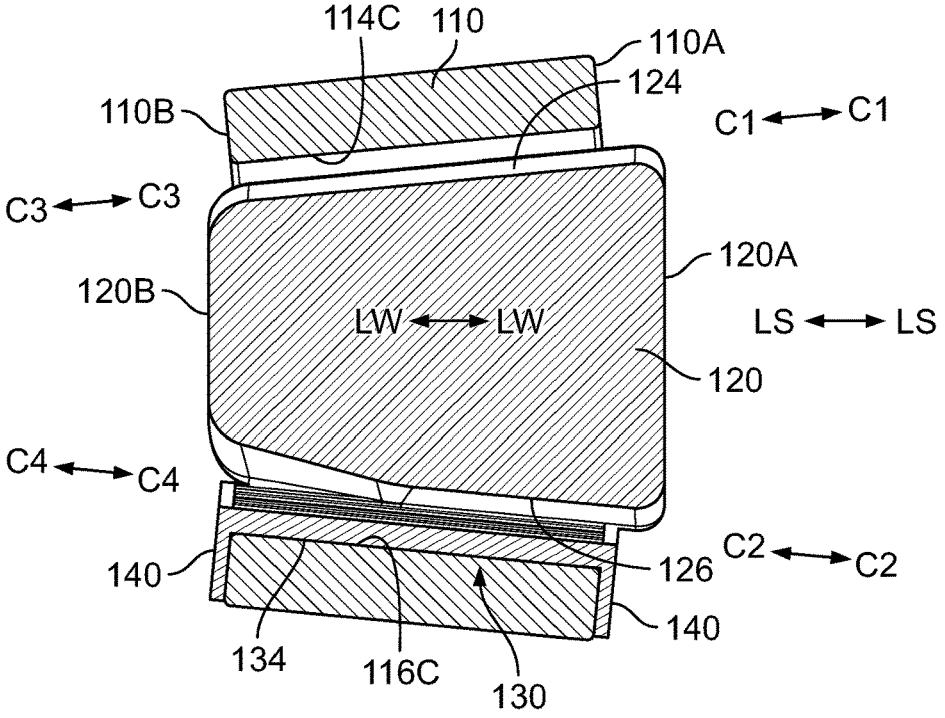
FIG. 4 is a cross-sectional view of the wedge connector assembly of FIG. 1 taken along the line 4-4 of FIG. 3.

The sleeve member 110 is C-shaped in cross-section. With reference to FIGS. 2 and 4, the sleeve member 110 tapers inwardly from a rear end 110A to a front end 110B. The sleeve member 110 includes an arcuate first side wall or receiver or hook portion 114, an arcuate second side wall or receiver or hook portion 116, and a connecting portion or body 112 extending therebetween. The hook portions 114, 116 extend longitudinally along opposed side edges of the body 112. The sleeve member 110 forms a chamber or cavity 115 defined by the inner surface of the sleeve member 110. In some embodiments, the sleeve member 110 is resiliently flexible.

The first hook portion 114 forms a concave first sleeve member cradle or channel 114A positioned along one side of the cavity 115. The hook portion 114 includes an engagement surface 114C in the channel 114A. The first channel 114A is adapted to receive and make contact with the conductor 14 at an apex of the channel 114A. The first hook portion 114 forms a radial bend that wraps around the conductor 14 for about 180 circumferential degrees in an exemplary embodiment, such that a distal end 114B of the first hook portion 114 faces toward the second hook portion 116.

Similarly, the second hook portion 116 forms a concave second sleeve member cradle or channel 116A positioned along an opposing side of the cavity 115 and opening to oppose the channel 114A. The hook portion 116 includes an engagement portion 116C in the channel 116A. The second channel 116A is adapted to receive and make contact with the conductor 12 at an apex of the channel 116A. The second hook portion 116 forms a radial bend that wraps around the conductor 12 for about 180 circumferential degrees in an exemplary embodiment, such that a distal end 116B of the second hook portion 116 faces toward the first hook portion 114.

The distal ends 114B and 116B define a longitudinally extending slot 117 therebetween that opens into the chamber 115.

With reference to FIG. 4, the sleeve member 110 has a lengthwise axis LS-LS. The first channel 114A defines a channel axis C1-C1. The second channel 116A defines a channel axis C2-C2. According to some embodiments and as illustrated, the channel axes C1-C1 and C2-C2 form an oblique angle relative to one another and, in some embodiments, the oblique angle is in the range of from about 10 to 12 degrees. According to some embodiments and as illustrated, the channel axes C1-C1 and C2-C2 form an oblique angle relative to the connector lengthwise axis L-L. When the connector assembly 100 is assembled, the channel axes C1-C1 and C2-C2 each extend transversely to and intersect the transverse axis M-M. According to some embodiments and as illustrated, the transverse axis M-M forms an oblique angle with each of the channel axes C1-C1 and C2-C2. The side channels 114A, 116A taper inwardly or converge from the rear end 110A to the front end 110B.

The wedge member 120 includes a body 122 having opposed, arcuate clamping side faces or walls 124, 126. The wedge member 120 tapers inwardly from a relatively wide rear end 120A to a relatively narrow front end 120B.

The clamping side walls or engagement surfaces 124, 126 define opposed, concave grooves or channels 124A, 126A. The channels 124A, 126A taper inwardly or converge from the rear end 120A to the front end 120B.

The wedge member 120 has a lengthwise axis LW-LW. The channel 124A defines a channel axis C3-C3. The channel 126A defines a channel axis C4-C4. According to some embodiments and as illustrated, the channel axes C3-C3 and C4-C4 form an oblique angle relative to one another and, in some embodiments, the oblique angle is in the range of from about 10 to 12 degrees. According to some embodiments and as illustrated, the channel axes C3-C3 and C4-C4 form an oblique angle relative to the connector lengthwise axis L-L. When the connector assembly 100 is assembled, the channel axes C3-C3 and C4-C4 each extend transversely to and intersect the transverse axis M-M. According to some embodiments and as illustrated, the transverse axis M-M forms an oblique angle with each of the channel axes C3-C3 and C4-C4.

The insert member 130 includes a concave, inner seating or conductor engagement surface 132 and an opposing convex, outer surface 134. The conductor engagement surface 132 defines an insert member trough or channel 136. Opposed lengthwise extending edges 138 define a longitudinally extending side opening 138A of the channel 136. Opposed, arcuate end edges 137 define opposed end openings 137A of the channel 136. The side opening 138A terminates at and merges with the end openings 137A. Opposed, integral retention tabs 140 depend from respective ones of the end edges 137. The insert member 130 may have a shape that is generally C- or U-shaped in cross-section or of a truncated tube.

Figure 3:
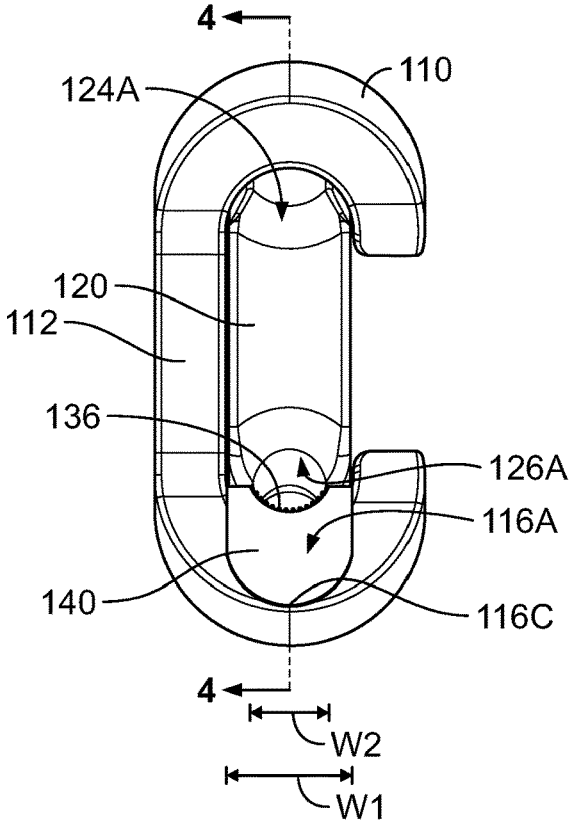
FIG. 3 is a front end view of the wedge connector assembly of FIG. 1.

The insert member 130 is adapted to be mounted in the wedge channel 116A as shown in FIGS. 1, 3 and 4 such that the insert member 130 nests within the channel 116A. According to some embodiments, the profile of the outer surface 134 is complementary to the profile of the surface 116C so that the insert member 130 generally conforms to the channel 116A. For example, in some embodiments, the profiles of the surfaces 116C, 134 are each laterally truncated cylindrical (i.e., semi-circular in cross-section) as illustrated.

The insert member 130 is removably retained in the channel 116A by the retention tabs 140. The retention tabs 140 overlap the opposed end faces of the sleeve member 110. The retention tabs 140 may be sized or shaped to create an interference fit between the retention tabs 140 and the end faces of the sleeve member 110 sufficient to retain the insert member 130 in the channel 116A unless and until a deliberate removal force is applied to the insert member 130. In other embodiments, the retention tabs 140 may be configured so that the insert member 130 fits loosely in the sleeve member channel 116A.

According to some embodiments, the insert member 130 is pre-installed in the sleeve member channel 116A in the factory. However, according to some embodiments, the insert member 130 may be installed in the channel 116A in the field by an installer, for example.

The insert member channel 136 is sized and shaped to cradle an elongate conductor (e.g., the conductor 12) and hold the conductor in position during assembly of the connector assembly 100. The channel 136 is smaller than (and may be shaped differently than) the sleeve member channel 116A to accommodate smaller sized elongate conductors than the channel 116A. The channel 136 includes an open side that receives the elongate conductor and exposes at least a circumferential portion of the elongate conductor. The open side of the channel 136 lies along the mating interface and generally faces toward the wedge member channel 126A.

Elongate ribs 133 are provided in the channel 136 and protrude radially inwardly from the concave surface 132.

The sleeve member 110 may be formed of any suitable material. According to some embodiments, the sleeve member 110 is formed of an electrically conductive material. According to some embodiments, the sleeve member 110 is formed of metal. According to some embodiments, the sleeve member 110 formed of aluminum or steel. The sleeve member 110 may be formed using any suitable technique. According to some embodiments, the sleeve member 110 is monolithic and unitarily formed. According to some embodiments, the sleeve member 110 is extruded and cut. Alternatively or additionally, the spring sleeve 110 may be stamped (e.g., die-cut), cast and/or machined.

The wedge member 120 may be formed of any suitable material. According to some embodiments, the wedge member 120 is formed of an electrically conductive material. According to some embodiments, the wedge member 120 is formed of metal. According to some embodiments, the wedge member 120 is formed of aluminum or copper alloy. The wedge member 120 may be formed using any suitable technique. According to some embodiments, the wedge member 120 is cast and/or machined. According to some embodiments, the wedge member 120 is monolithic and unitarily formed.

The insert member 130 may be formed of any suitable material. According to some embodiments, the insert member 130 is formed of an electrically conductive material. According to some embodiments, the insert member 130 is formed of metal. According to some embodiments, the insert member 130 is formed of aluminum or copper alloy. The insert member 130 may be formed using any suitable technique. According to some embodiments, the insert member 130 is cast and/or machined. According to some embodiments, the insert member 130 is monolithic and unitarily formed.

Exemplary methods for assembling and using the wedge connector system 101 in accordance with embodiments of the present invention will now be described.

The insert member 130 may be pre-installed in the channel 116A of the C-shaped sleeve member 110 in the factory. Alternatively, the insert member 130 may be provided to the installer as a separate component not mounted in the channel 116A.

As discussed in more detail below, the conductors 12, 14 can be clamped in selected ones of the channels 114A, 116A, 136, depending on the sizes of the conductors 12, 14 to be connected. The installer can elect to place an elongate conductor in the channel 116A (with the insert member 130 not present in the channel 116C) or, alternatively, in the channel 136 (with the insert member 130 mounted in the channel 116A).

The insert member 130 serves as a spacer that reduces the effective depth, volume and/or size of the sleeve member channel 116A within which it is mounted. The insert member 130 partially fills the void of the sleeve member channel 116A so that the distance between the wedge member engagement surface 126 and the opposing abutment is reduced. The channels 116A and 136 are different from one another in cross-sectional size and/or shape so that they are each sized or configured to accommodate a different size elongate conductor in a different range of diameters. In some embodiments, the depth of the channel 136 is less than the depth of the channel 116A. In some embodiments, the radius of curvature of the channel 136 is less than that of the channel 116A. The channel 116A has a width W1, and the channel 136 has a width W2 (FIG. 3). In some embodiments, the width W2 is less than the width W1.

In some embodiments, the installer determines the size (e.g., the diameter or gauge) of the elongate conductor 12 and then determines which of the channels 116A, 136 is of the appropriate corresponding or prescribed channel size to receive an elongate conductor of this size. If the channel 136 is selected, the insert member 130 is mounted in the channel 116A (or is left in the channel 116A if the insert member 130 is already mounted therein) to form a sleeve subassembly, and the conductor 12 is then mounted in the channel 136. If the channel 116A is selected, the insert member 130 is not mounted in the channel 116A (or is removed from the channel 116A if pre-installed) and the conductor 12 is mounted directly in the channel 116A.

In the method illustrated in FIGS. 1-4, the channel 136 of the insert member 130 is selected for receiving the conductor 12. The C-shaped sleeve member 110 is placed over the conductor 12 such that the conductor 12 is received in the side channel 136 (which is in turn received in the side channel 116C). The conductor 14 is placed in the other side channel 114A.

The wedge member 120 is inserted into the sleeve member cavity 115. The wedge member 120 is partially inserted into the cavity 115 between the conductors 12, 14 such that the conductors 12, 14 are received in the opposed grooves 124A, 126A. The wedge member 120 may be forced into the sleeve member 110 by hand or using a hammer or the like to temporarily hold the wedge member 120 and the conductors 12, 14 in position.

The wedge member 120 and the C-shaped sleeve member 110 are then forcibly driven in axially opposing directions relative to one another so that the wedge member 120 is driven in a forward direction F (FIG. 2) into the sleeve member 110. In some embodiments, the members 110, 120 are driven together using a powder actuated tool. The powder actuated tool may be a tool such as described in U.S. Pat. No. 6,996,987 to Gregory et al., for example. In other embodiments, the members 110, 120 are driven together using a hammer or the like.

The sections of the conductors 12, 14 interposed between the sleeve member 110 and the wedge member 120 (and between the sleeve member 110 and the insert member 130) are uninsulated and bare or exposed so that the conductor 14 makes direct contact with the sleeve member 110 and the wedge member 120, and the conductor 12 makes direct contact with the sleeve member 110 and the insert member 130. According to some embodiments, the insert member 130 is electrically conductive (e.g., formed of metal) so that the bare section of the conductor 12 makes direct electrical contact (metal-to-metal contact) with the insert member 130 and, in particular, the concave conductor engagement surface 132. According to some embodiments, the sleeve member 110 and the wedge member 120 are also electrically conductive (e.g., formed of metal) so that the bare sections of the conductors 12, 14 make direct electrical contact (metal-to-metal contact) with the sleeve member 110 and the wedge member 120 and, in particular, with the engagement surfaces 114C, 124, 126 (and the engagement surface 116C, if the insert member 130 is not used for the conductor 12).

The elongate, protruding ribs 133 provided in the channel 136 of the insert member 130 can provide better grip between the conductor 12 and the insert member 130. The ribs 133 can also improve or enhance electrical contact between the conductor 12 and the insert member 130 by breaking through oxides on the conductor 12 and increasing contact surface area.

The wedge member 120 and the sleeve member 110 are thereby linearly displaced and pulled or pushed together in opposed converging directions to the closed position of the connector system 101. The section of the conductor 12 in the sleeve member 110 is abutted by the opposing facing engagement surfaces 132 and 126 of the channel 136 and the channel 126A. The section of the conductor 14 in the sleeve member 110 is abutted by the opposing facing engagement surfaces 114C and 124 of the channel 114A and the channel 124A. These surfaces apply clamping loads onto the conductors 12, 14, thereby capturing the conductors 12, 14 in the connector 100 and electrically connecting the conductors 12, 14 to one another through the connector 100.

The wedge member 120, the sleeve member 110, the insert member 130, and/or the conductors 12, 14 may be deformed. The C-shaped sleeve member 110 may be elastically deformed so that it applies a bias or spring force against the wedge member 120 and the conductors 12, 14. The sleeve member 110 may be plastically deformed.

In some embodiments, the hook portions 114, 116 are deflected outward along the transverse axis M-M. The sleeve member 110 is elastically and plastically deflected resulting in a spring back force (i.e., from stored energy in the bent sleeve member 110) to provide a clamping force on the conductors 12, 14. As a result of the clamping force, the sleeve member 110 may generally conform to the conductors 12, 14. According to some embodiments, a large application force, on the order of about 26 to 31 kN of clamping force is provided, and the clamping force ensures adequate electrical contact force and electrical connectivity between the connector assembly 100 and the conductors 12, 14. Additionally, elastic deflection of the sleeve member 110 provides some tolerance for deformation or compressibility of the conductors 12, 14 over time, such as when the conductors 12, 14 deform due to compression forces. Actual clamping forces may be lessened in such a condition, but not to such an amount as to compromise the integrity of the electrical connection.

A corrosion inhibitor compound may be provided (i.e., applied at the factory) on the conductor contact surfaces of the wedge member 120, the sleeve member 110 and/or the insert member 130. The corrosion inhibitor may prevent or inhibit corrosion formation and assist in abrasion cleaning of the conductors 12, 14. The corrosion inhibitor can inhibit corrosion by limiting the presence of oxygen at the electrical contact areas. The corrosion inhibitor material may be a flowable, viscous material. The corrosion inhibitor material may be, for example, a base oil with metal particles suspended therein. In some embodiments, the corrosion inhibitor is a cod oil derivative with aluminum nickel alloy particles. Suitable inhibitor materials are available from TE Connectivity. According to some embodiments, the corrosion inhibitor layer has a thickness in the range of from about 0.02 to 0.03 inch.

It will be appreciated that the connector assembly 100 can effectively accommodate conductors 12, 14 of a range or different sizes and configurations as a result of the flexibility of the sleeve member 110 and customization permitted by the insert member 130.

While only one insert member 130 is shown installed in the channel 116A, an additional insert member configured in the same manner as the insert member 130 or having different dimensions can be installed in the channel 114A to accommodate a different range of sizes of conductor 14 on that side of the connector 100.

While a particular configuration of the connector 100 and the conductors 12, 14 is shown in FIG. 1 and described above, other configurations may be employed as desired. The installer may elect to also install an insert member 130 in the sleeve member channel 114A in addition to or instead of the sleeve member channel 116A.

In some embodiments, a connector system may be provided including a plurality of insert members 130 of different sizes and shapes to accommodate conductors 12, 14 of different ranges of sizes (e.g., different depths and/or widths to accommodate different conductor diameters). The installer can then selectively choose (from the supplied plurality of insert members 130) the insert member or members 130 appropriate for the conductors 12, 14 to be connected.

Different connector assemblies 100 can themselves be sized to accommodate different ranges of conductor sizes, from relatively small diameter wires for low current applications to relatively large diameter wires for high voltage energy transmission applications. In some embodiments, the size of the main conductor 14 is 336.4 kcmil or greater and the size of the tap conductor 12 is #6 AWG or greater.

It is recognized that effective clamping force on the conductors 12, 14 is dependent upon the geometry and dimensions of the members 110, 120 and the insert member 130 and size of the conductors used with the connector assembly 100. Thus, with strategic selections of angles for the engagement surfaces, and the size and positioning of the conductors 12, 14, varying degrees of clamping force may be realized when the connector assembly 100 is used as described above.

As illustrated, the channels 114A, 116A, 136 are generally arcuate. However, some or all of the channels 114A, 116A, 136 may have cross-sectional shapes of other configurations.

With reference to FIGS. 6-10, a wedge connector system 201 and a wedge connector assembly 200 according to further embodiments is shown therein. The connector assembly 200 corresponds to and may be used in the same manner as the connector assembly 100, except as discussed below, to form a connection 7 with conductors 12, 14. The connector assembly 200 includes a sleeve member 210 and a wedge member 220, corresponding to the sleeve member 110 and the wedge member 120, respectively. The connector assembly 200 includes an insert assembly 231.

The insert assembly 231 includes an insert member 230 and an integral retention feature 242A. In some embodiments, the retention feature 242A is a pin, screw, post or other member formed separately from the insert member 230 and affixed to the insert member 230. For example, the retention member 242A may be press fit in a bore 242B in the insert member 230. The retention feature 242A projects outwardly from the outer side of the insert member 230.

The sleeve member 210 includes a retention hole 250 extending through the hook portion 216. In use, the insert assembly 231 is seated in the sleeve member channel 216A with the retention feature 242A seated in the retention hole 250. The retention feature 242A thereby prevents or inhibits axial displacement of the insert member 230 in the sleeve member 210 when the wedge member 220 is forced into clamping engagement as described above.

The insert member 230 has a smooth inner engagement surface 232. The insert member 230 also differs from the insert member 130 in that the insert member 230 includes an axially extending raised channel 244A flanked on either side by opposed, axially extending relief channels 244B. The relief channels 244B provide clearance so that the outer edges 226D of the wedge member 220 do not abut the insert member 230, which may interfere with application of the desired clamping load on the conductor 12.

As discussed above with regard to the connector system 101, the sleeve member 210 can be used with or without the insert member 230, depending on the size of the conductor to be connected.

Figure 11:
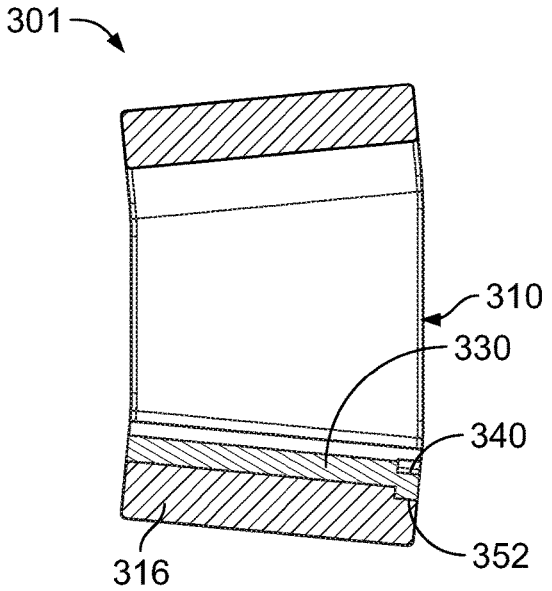
FIG. 11 is a cross-sectional view of a wedge connector system according to further embodiments.
Figure 12:
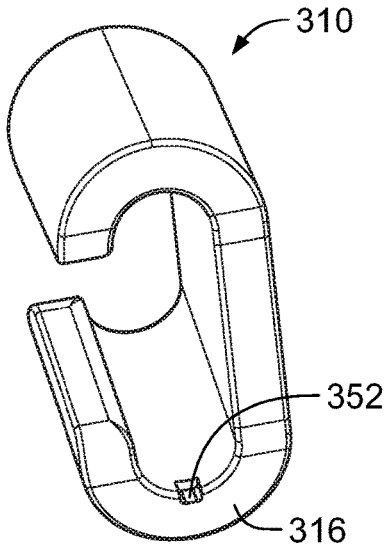
FIG. 12 is a rear perspective view of a sleeve member forming a part of the wedge connector system of FIG. 11.
Figure 13:
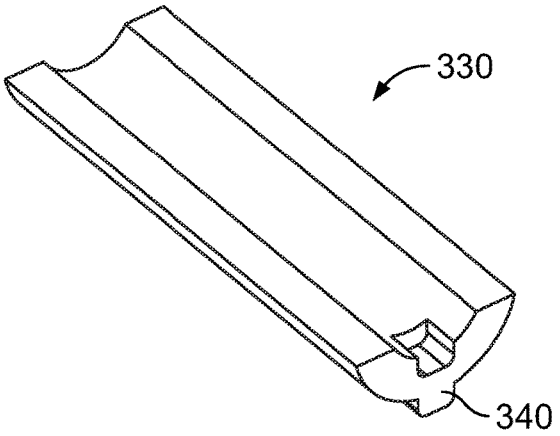
FIG. 13 is a perspective view of an insert member forming a part of the wedge connector system of FIG. 11.

With reference to FIGS. 11-13, a wedge connector system 301 according to further embodiments of the invention is shown therein. The wedge connector system 301 includes a sleeve member 310, an insert member 330, and the wedge member 120 (FIG. 2). The connector system 301 corresponds to and may be used in the same manner as the connector assembly 100, except as discussed below.

The insert member 330 includes an integral retention feature or tab 340. The retention feature 340 is located on the rear end of the insert member 330 and projects outwardly from the outer side of the insert member 330.

The sleeve member 310 includes a retention recess, slot or notch 352 defined in the hook portion 316 at the rear end of the sleeve member 310. In use, the insert member 330 is seated in the sleeve member channel 316 with the retention tab 340 seated in the retention notch 352. The retention tab 340 thereby prevents or inhibits axial displacement of the insert member 330 in the sleeve member 310 when the wedge member (e.g., wedge member 120) is forced into clamping engagement as described above.

As discussed above with regard to the connector system 101, the sleeve member 310 can be used with or without the insert member 330, depending on the size of the conductor to be connected.

Figure 14:
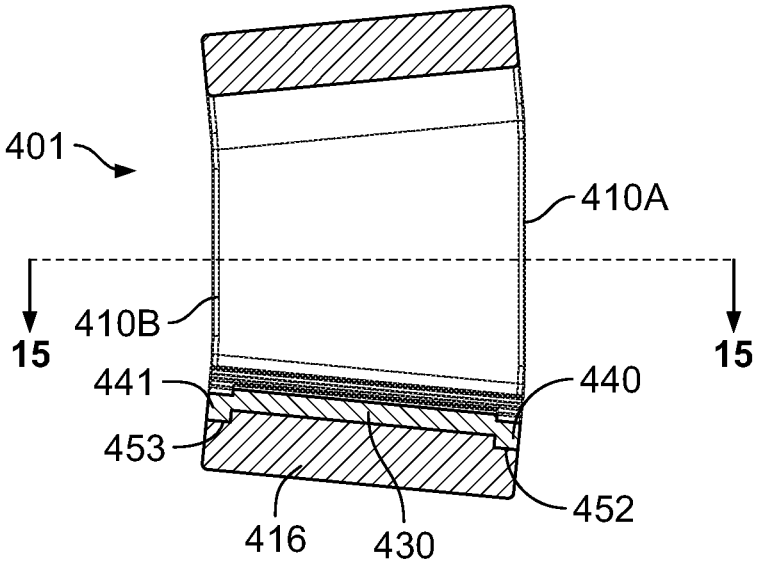
FIG. 14 is a cross-sectional view of a wedge connector system according to further embodiments.
Figure 15:
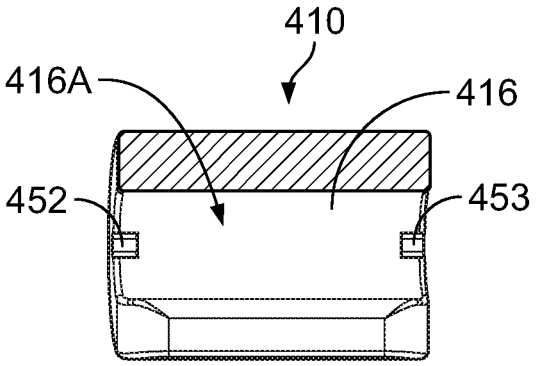
FIG. 15 is a cross-sectional view of a sleeve member forming a part of the wedge connector system of FIG. 14 taken along the line 15-15 of FIG. 14.
Figure 16:
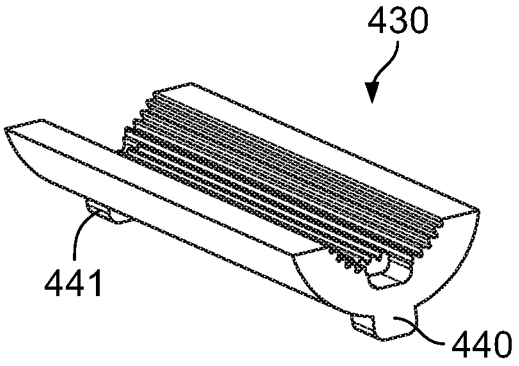
FIG. 16 is a perspective view of an insert member forming a part of the wedge connector system of FIG. 14.

With reference to FIGS. 14-16, a wedge connector system 401 according to further embodiments of the invention is shown therein. The wedge connector system 401 includes a sleeve member 410, an insert member 430, and the wedge member 120 (FIG. 2). The connector system 401 corresponds to and may be used in the same manner as the connector assembly 100, except as discussed below.

The insert member 430 includes a first integral retention feature or tab 440 and an opposed second integral retention feature or tab 441. The first retention tab 440 is located on the rear end of the insert member 430 and the second retention tab 441 is located on the front end of the insert member 430. The retention tabs 440, 441 project outwardly from the outer side of the insert member 430.

The sleeve member 410 includes first and second retention notches 452, 453 defined in the hook portion 416 at the rear end 410A and front end 410B, respectively, of the sleeve member 410. In use, the insert member 430 is seated in the sleeve member channel 416A with the retention tabs 440 and 441 seated in the retention notches 452 and 453, respectively. The retention tabs 440, 441 thereby prevent or inhibit axial displacement of the insert member 430 in the sleeve member 410 when the wedge member (e.g., wedge member 120) is forced into clamping engagement as described above.

As discussed above with regard to the connector system 101, the sleeve member 410 can be used with or without the insert member 430, depending on the size of the conductor to be connected.

Figure 17:
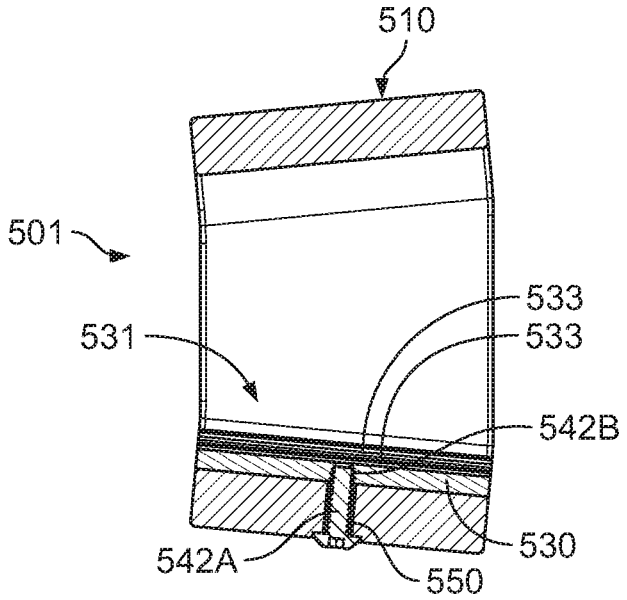
FIG. 17 is a cross-sectional view of a wedge connector system according to further embodiments.
Figure 18:
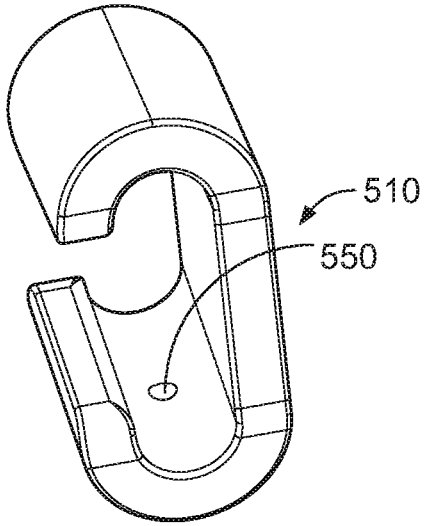
FIG. 18 is a perspective view of an insert member forming a part of the wedge connector system of FIG. 17.
Figure 19:
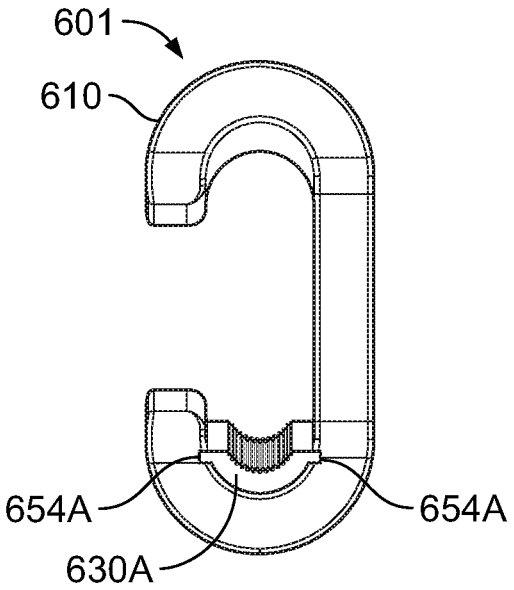
FIG. 19 is a rear end view of a wedge connector system according to further embodiments.
Figure 20:
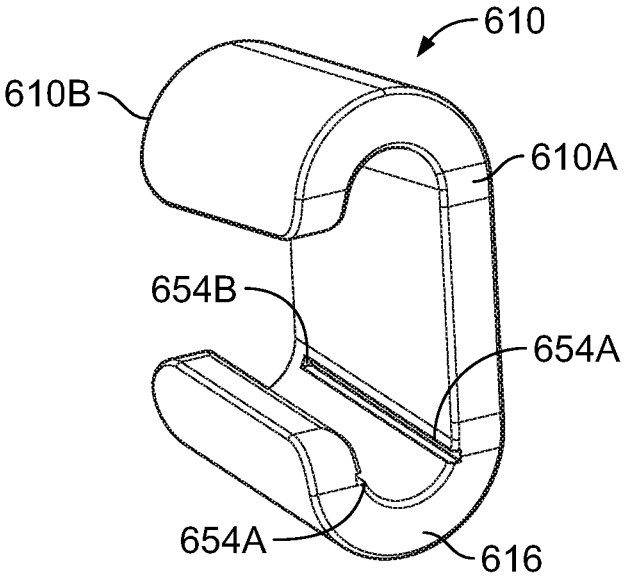
FIG. 20 is a rear perspective view of a sleeve member forming a part of the wedge connector system of FIG. 19.
Figure 21:
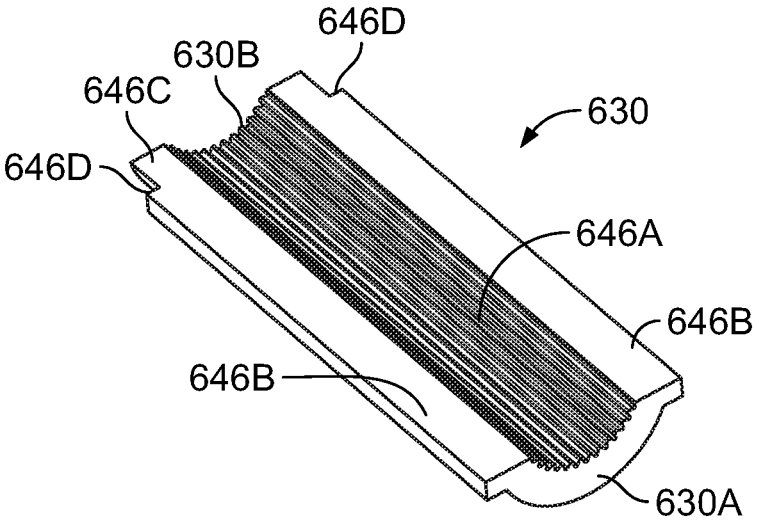
FIG. 21 is a rear perspective view of an insert member forming a part of the wedge connector system of FIG. 19.
Figure 22:
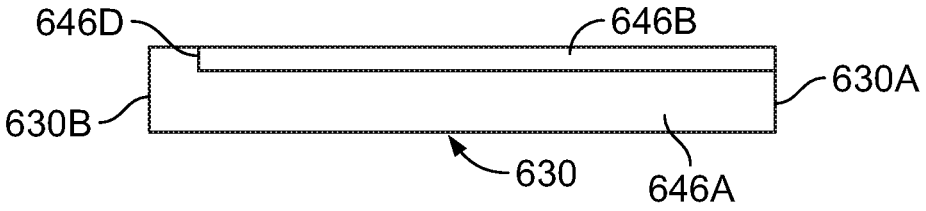
FIG. 22 is a side view of the insert member of FIG. 21.
Figure 23:
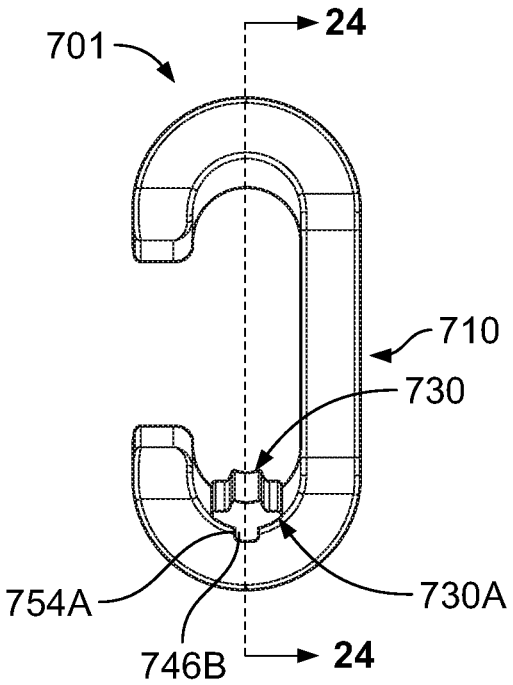
FIG. 23 is a rear end view of a wedge connector system according to further embodiments.
Figure 24:
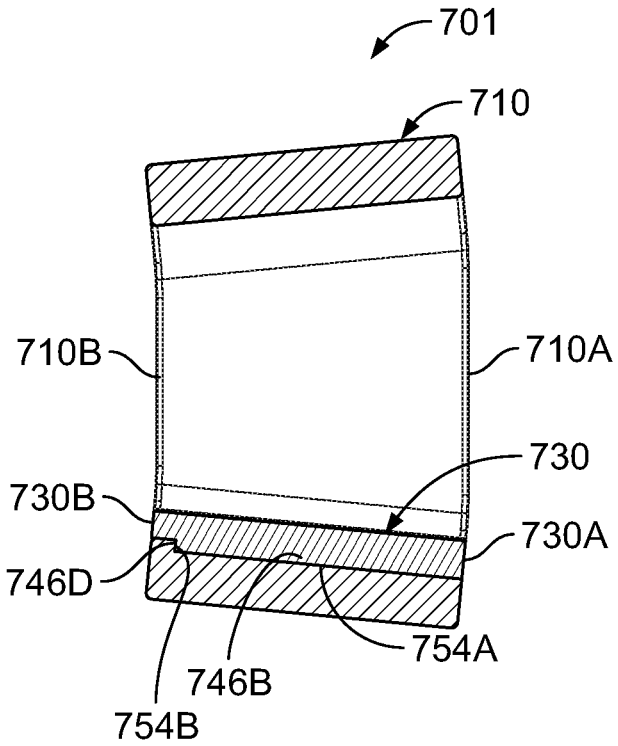
FIG. 24 is a cross-sectional view of the wedge connector system of FIG. 23 taken along the line 24-24 of FIG. 23.
Figure 25:
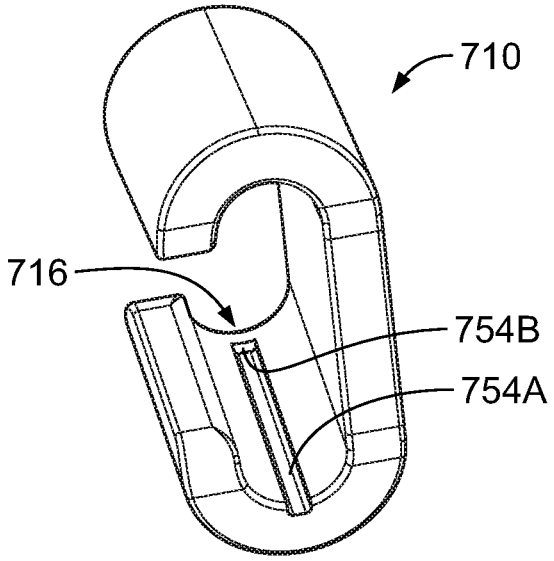
FIG. 25 is a rear perspective view of a sleeve member forming a part of the wedge connector system of FIG. 23.
Figure 26:
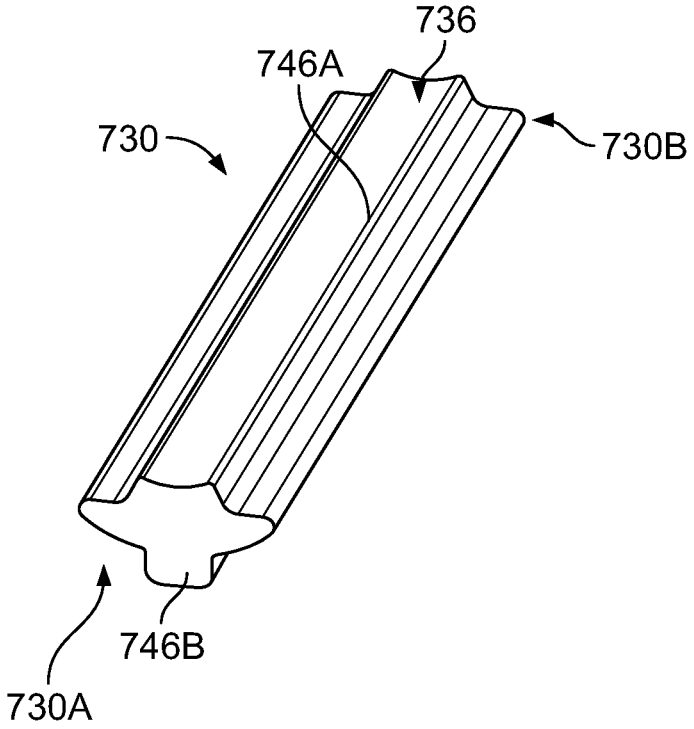
FIG. 26 is a rear perspective view of an insert member forming a part of the wedge connector system of FIG. 23.

With reference to FIGS. 17 and 18, a wedge connector system 501 according to further embodiments of the invention is shown therein. The wedge connector system 501 includes a sleeve member 510, an insert assembly 531, and the wedge member 120 (FIG. 2).

The connector assembly 501 corresponds to and may be used in the same manner as the connector system 201, except as follows. The connector assembly 501 differs from the connector system 201 in that the inner engagement surface of the insert member 530 includes ribs 533 corresponding to the ribs 133.

The insert assembly 531 includes an insert member 530 and a retention member in the form of a screw 542A. The screw 542A extends through a retention hole 550 in the sleeve member 510 and is screwed into a threaded bore 542B in the insert member 530.

As discussed above with regard to the connector system 101, the sleeve member 510 can be used with or without the insert member 530, depending on the size of the conductor to be connected.

With reference to FIGS. 19-22, a wedge connector system 601 according to further embodiments of the invention is shown therein. The wedge connector system 601 includes a sleeve member 610, an insert member 630, and the wedge member 120 (FIG. 2). The connector system 601 corresponds to and may be used in the same manner as the connector assembly 100, except as discussed below.

The insert member 630 includes opposed integral, axially extending side flanges 646B. The flanges 646B extend laterally outwardly from a main section 646A, which includes the conductor channel 636. The main section 646A extends from the rear end 630A of the insert member 630 to the front end 630B. Each flange 646B extends from the rear end 630A to a terminal front end spaced apart from the front end 630B. As a result, the insert member 630 has a reduced width section 646C at its front end and the side flanges 646B define laterally opposed stop walls 646D.

The sleeve member 610 includes laterally opposed, axially extending retention slots 654A defined in the hook portion 616. Each slot 654A extends from the sleeve member rear end 610A to a terminal front end spaced apart from the front end 610B of the sleeve member 610. As a result, each slot 654A ends at a stop wall 654B.

In use, the insert member 630 is seated in the sleeve member channel 616A with the side flanges 646B seated in the retention slots 654A. The insert member stop walls 646D are positioned adjacent the sleeve member stop walls 654B. The flanges 646B and slots 654A thereby cooperate to prevent or inhibit axial displacement of the insert member 630 in the sleeve member 610 when the wedge member (e.g., wedge member 120) is forced into clamping engagement as described above.

As discussed above with regard to the connector system 101, the sleeve member 610 can be used with or without the insert member 630, depending on the size of the conductor to be connected.

With reference to FIGS. 23-26, a wedge connector system 701 according to further embodiments of the invention is shown therein. The wedge connector system 701 includes a sleeve member 710, an insert member 730, and the wedge member 120 (FIG. 2). The connector system 701 corresponds to and may be used in the same manner as the connector assembly 100, except as discussed below.

The insert member 730 has a raised channel as discussed above with regard to the connector 200. The insert member 730 includes an integral, axially extending bottom rail or flange 746B. The flange 746B extends downwardly from a main section 746A, which includes the conductor channel 736. The main section 746A extends from the rear end 730A of the insert member 730 to the front end 730B. The flange 746B extends from the rear end 730A to a terminal front end spaced apart from the front end 730B. As a result, the bottom flange 746B defines a stop wall 746D set back from the front end 730B.

The sleeve member 710 includes an axially extending retention slot 754A defined in the channel 716A of the hook portion 716. The slot 754A extends from the rear end 710A to a terminal front end spaced apart from the front end 710B of the sleeve member 710. As a result, the slot 754A ends at a stop wall 754B.

In use, the insert member 730 is seated in the sleeve member channel 716A with the flange 746B seated in the retention slot 754A. The insert member stop wall 746D is positioned adjacent the sleeve member stop wall 754B. The flange 746B and slot 754A thereby cooperate to prevent or inhibit axial displacement of the insert member 730 in the sleeve member 710 when the wedge member (e.g., wedge member 120) is forced into clamping engagement as described above.

As discussed above with regard to the connector system 101, the sleeve member 710 can be used with or without the insert member 730, depending on the size of the conductor to be connected.

With reference to FIGS. 27-30, a wedge connector system 801 and a wedge connector assembly 800 according to further embodiments is shown therein. The connector assembly 800 corresponds to and may be used in the same manner as the connector assembly 100, except as discussed below, to form a connection 9 with conductors 12, 14. The connector assembly 800 includes a sleeve member 810 and a wedge member 820, corresponding to the sleeve member 110 and the wedge member 120, respectively. The connector assembly 800 also includes a drive/lock mechanism 861. The connector assembly 800 also includes an insert assembly 831. The sleeve member 810 and the wedge member 820 are movable relative to one another to cooperatively mechanically capture the conductors 12, 14 therebetween and electrically connect the conductors 12, 14 to one another.

The wedge member 820 includes a body 822 having opposed, arcuate clamping side faces or walls 824, 826. The wedge member 820 tapers inwardly from a relatively wide rear end to a relatively narrow front end.

An integral boss 827 is located proximate the rear end 820A. A bore 827A extends through the boss 827. In some embodiments, the bore 827A is nonthreaded.

The lock mechanism 861 includes a lock member 860, a first drive member 862, a cooperating second drive member 864, a washer 865, and a retainer clip 866. In some embodiments and as shown, the first drive member is a drive bolt 862 and the second drive member is a nut 864. The drive bolt 862 and the nut 864 operate as a clamping mechanism.

The lock member 860 includes an integral rear engagement or hook portion 860A and an integral nut holder portion 860B.

The nut holder portion 860B is a boss located on the front end. The nut holder portion 860B includes a bore 860C.

Anti-rotation features in the form of flats are located in the bore 860C and define a hexagonal passage.

The bolt 862 has an externally threaded cylindrical shaft 862A and an integral driver engagement feature 862B on the rear end of the shaft 862A. The driver engagement feature 862B may be provided in the form of a geometric head (e.g., a hexagonal faceted head) or a geometric socket. The drive head 862B may be a hex head as illustrated, for example.

An annular retainer ring mount slot 862C is defined in the outer surface of the bolt 862 proximate the head 862B. The retainer clip 866 is seated in the slot 862C. The retainer clip 866 is thereby positioned on front side of the boss 827, opposite the bolt head 862B. The retainer clip 866 permits the bolt 862 to rotate about the bolt's lengthwise axis relative to the boss 827, but limits relative rearward axial displacement of the bolt 862 relative to the boss 827. In this way, the retainer clip 866 prevents the bolt from moving rearwardly out of the boss 827 beyond a relatively short prescribed distance.

The nut 864 is an extended or elongate capped coupling nut. The nut 864 has an internally threaded bore 864A. The outer surface of the nut body 864B has geometric engagement facets or faces and is hexagonal in cross-section. The nut 864 also has a stop feature 864C on the capped end of the body 864B having an outer diameter greater than that of the nut body 864B. The nut 864 is seated in the bore 860C such that the faceted outer surface of the nut 864 mates with the complementary faceted inner surface of the bore 860C to prevent or limit rotation of the nut 864 relative to the bore 860C. The nut body 864B is permitted to slide axially through the bore 860C. The stop feature 864C is sized to prevent it from passing through the bore 860C.

The insert assembly 831 includes an insert member 830 and an integral retention feature 842A corresponding to the insert member 530 and the retention feature 542A of the connector system 501.

The sleeve member 810 includes a retention hole 850 corresponding to the retention hole 250 of the connector 200.

The insert member 830 includes an axially extending raised channel and relief channels as described above with regard to the connector 200, which provide clearance for the outer edges of the wedge member 820.

Exemplary methods for assembling and using the connector assembly 800 in accordance with embodiments of the present invention will now be described.

The insert assembly 831 is seated in the sleeve member channel 816A with the retention feature 842A seated in the retention hole 850 as described with regard to the connector. The retention feature 842A thereby prevents or inhibits axial displacement of the insert member 830 in the sleeve member 810 when the wedge member 820 is forced into clamping engagement as described above.

Figure 27:
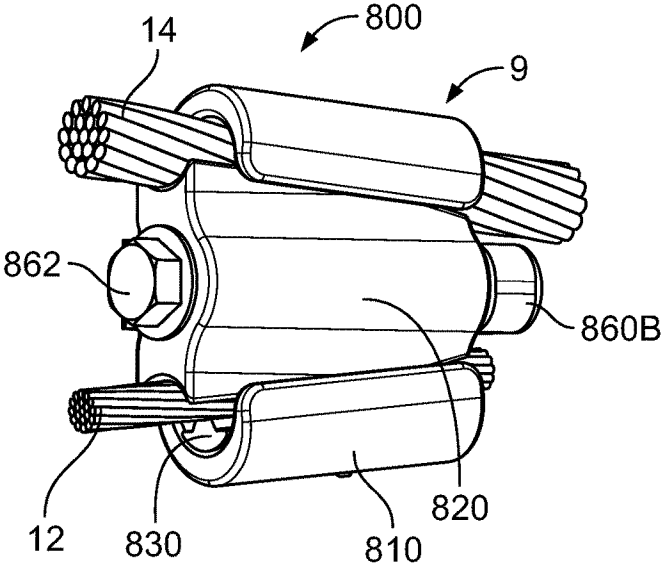
FIG. 27 is a rear perspective view of a wedge connector system, and a wedge connector assembly and a connection formed thereby, according to further embodiments.
Figure 28:
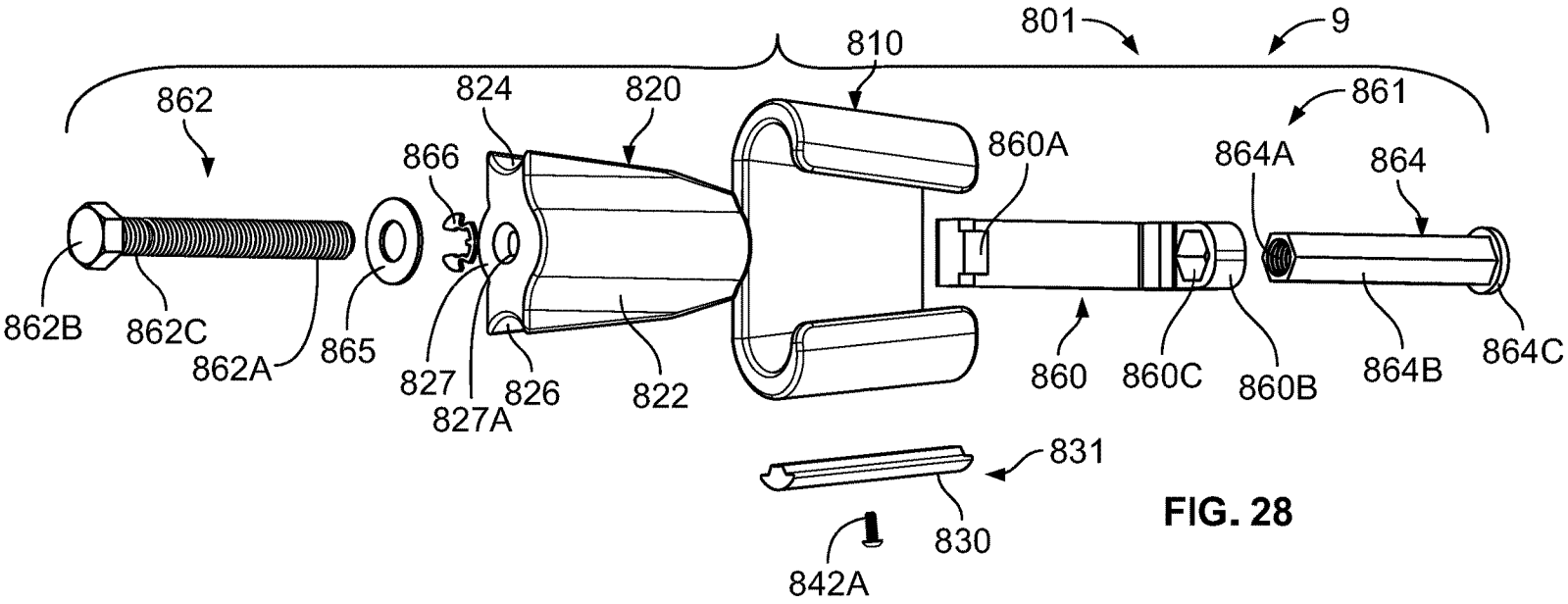
FIG. 28 is an exploded, rear perspective view of the connection of FIG. 27.
Figure 29:
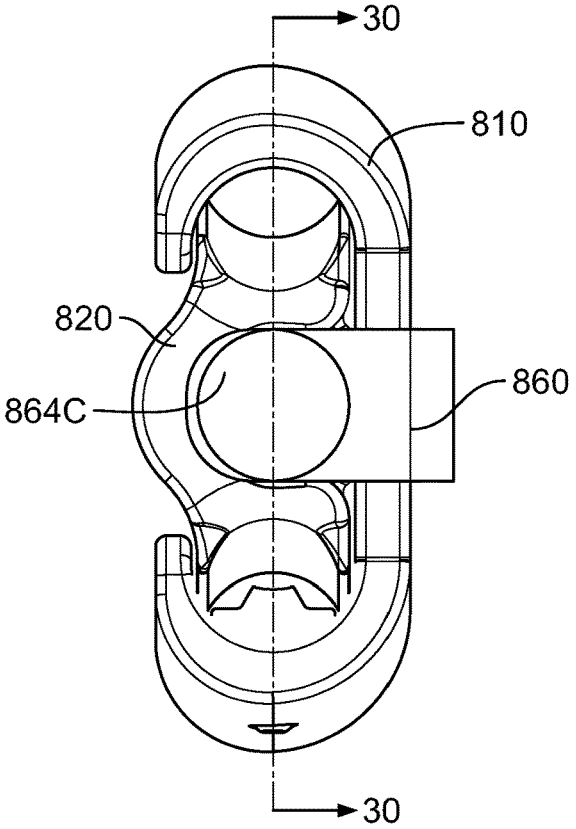
FIG. 29 is a front end view of the wedge connector assembly of FIG. 27.
Figure 30:
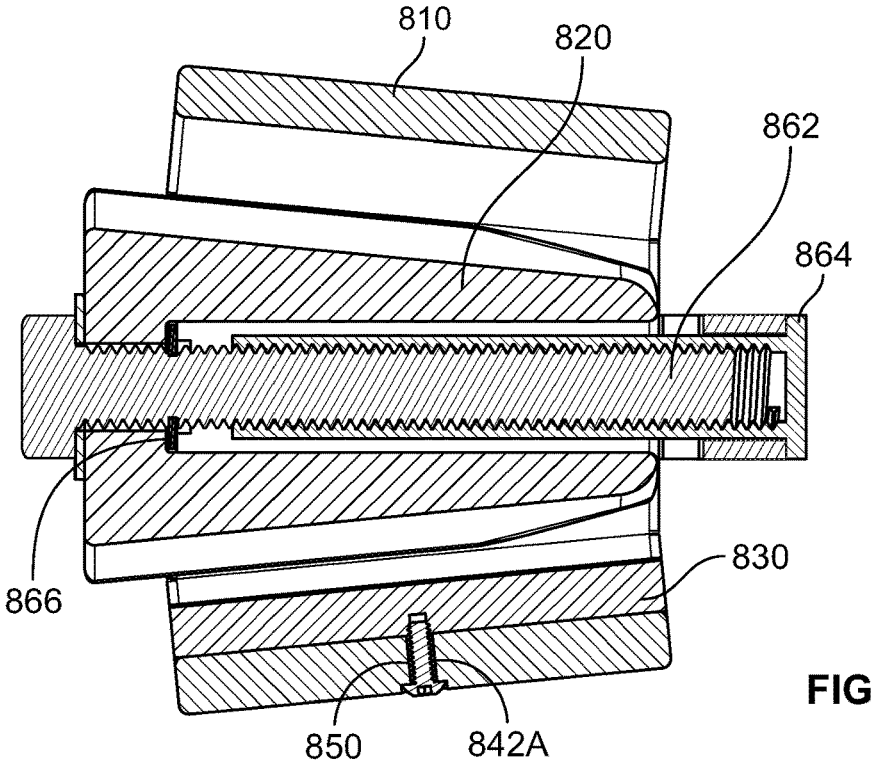
FIG. 30 is a cross-sectional view of the wedge connector assembly of FIG. 27 taken along the line 30-30 of FIG. 29.

In order to assemble the wedge connector assembly 800, the lock member 860 is mounted on the sleeve member 810 as shown in FIGS. 27, 29 and 30 such that the rear edge of the sleeve member 810 is received and captured in the hook portion 860A. The lock member extends along the outside of the sleeve member connecting portion 812. The nut holder portion 860B is positioned at the front end of the sleeve member 810.

The nut 864 is inserted through the bore 860C. The washer 865 is mounted on the bolt 862 and the bolt 862 is then is inserted through the bore 827A. The retainer clip 866 is then mounted on the bolt 862 in the slot 862C. The bolt 862 is thereby secured in the wedge member 820 to form a wedge subassembly.

As shown in FIG. 27, the C-shaped sleeve member 810 is placed over the conductor 12 such that the conductor 12 is received in the side channel 816A. The conductor 14 is placed in the other side channel 814A.

The wedge subassembly is partially inserted into the cavity between the conductors 12, 14 such that the conductors 12, 14 are received in the opposed grooves 824A, 826A of the wedge member 820. The wedge member 820 may be forced into the sleeve member 810 by hand or using a hammer or the like to temporarily hold the wedge member 820 and the conductors 12, 14 in position.

The front end of the bolt 862 is then threadedly engaged with the nut 864. As the bolt 862 is rotated (e.g., using a hand tool or electric or air-powered rotary driver), the nut 864 is drawn axially further into the bore 860C until the stop feature 864C abuts the nut holder portion 860B. The bolt 862 is further rotated so that the nut 864 is axially anchored and the bolt 862 forcibly pulls the wedge member 820 into the sleeve member 810 until the wedge member 820 is in a desired final position to form the connection as shown in FIG. 27. The connection 9 may be formed by forming interference fits between the wedge member 820, the C-shaped sleeve member 810, the insert member 830, and the conductors 12, 14.

As discussed above with regard to the wedge connector system 101, the wedge member 820, the sleeve member 810 and/or the conductors 12, 14 may be deformed. The C-shaped sleeve member 810 may be elastically deformed so that it applies a bias or spring force against the wedge member 820 and the conductors 12, 14. The sleeve member 810 may be plastically deformed.

The connector system 801 can be removed and disassembled by rotating the bolt 862 counterclockwise to force the nut 864 to move axially forwardly and away from the bolt head 862B. The front end of the nut 864 is then struck (e.g., by a hammer) to drive the bolt 862 rearwardly.

Figure 31:
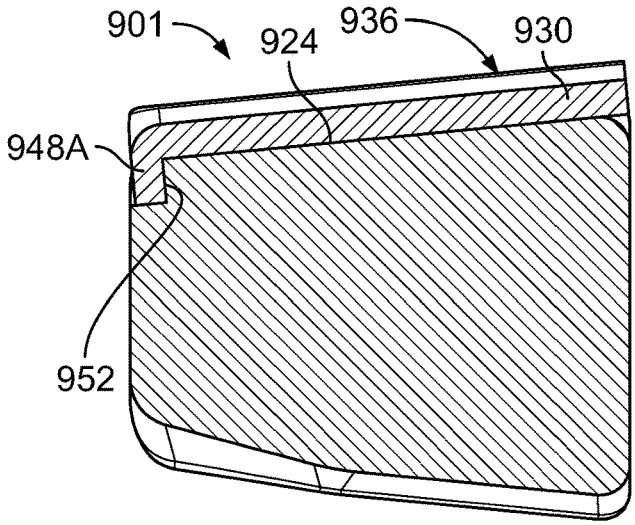
FIG. 31 is a cross-sectional view of a wedge connector system according to further embodiments.
Figure 32:
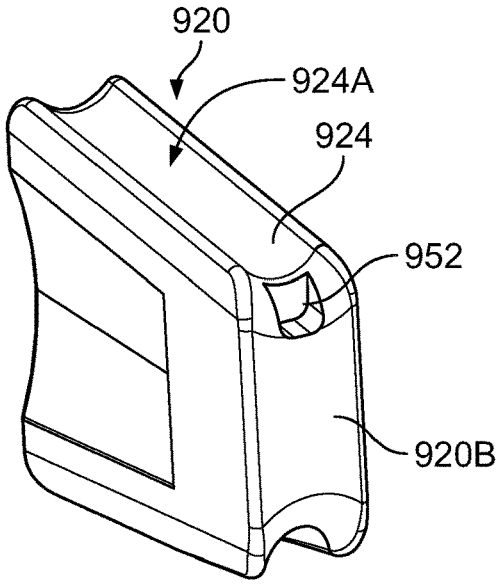
FIG. 32 is a front perspective view of a wedge member forming a part of the wedge connector system of FIG. 31.
Figure 33:
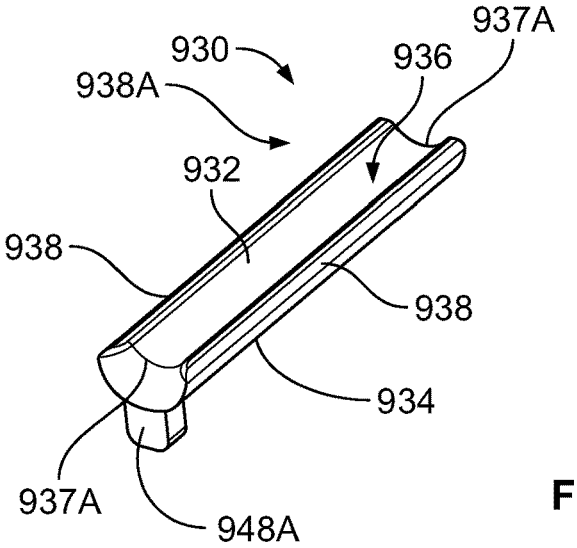
FIG. 33 is a front perspective view of an insert member forming a part of the wedge connector system of FIG. 31.

With reference to FIGS. 31-33, a wedge connector system 901 according to further embodiments of the invention is shown therein. The wedge connector system 901 includes a wedge member 920, an insert member 930, and the sleeve member 110 (FIG. 2). The connector system 901 corresponds to and may be used in the same manner as the connector assembly 100, except as discussed below.

The wedge member 920 is constructed in the same manner as the wedge member 120, except as follows. The wedge member 920 includes a retention notch 952 defined in its front end 920B.

The insert member 930 includes a concave, inner seating or conductor engagement surface 932 and an opposing convex, outer surface 934. The conductor engagement surface 932 defines an insert member trough or channel 936. Opposed lengthwise extending edges 938 define a longitudinally extending side opening 938A of the channel 936. Opposed, arcuate end edges define opposed end openings 937A of the channel 936. The side opening 938A terminates at and merges with the end openings 937A. The insert member 930 may have a shape that is generally C- or U-shaped in cross-section or of a truncated tube.

The insert member 930 includes an integral retention feature or tab 948A. The retention feature 948A is located on the front end of the insert member 930 and projects outwardly from the outer side of the insert member 930.

The insert member 930 is adapted to be mounted in the wedge member conductor channel 924A as shown in FIG. 31 such that the insert member 930 nests within the channel 924A. According to some embodiments, the profile of the outer surface 934 is complementary to the profile of the wedge member engagement surface 924 so that the insert member 930 generally conforms to the channel 924A. For example, in some embodiments, the profiles of the surfaces 924, 934 are each laterally truncated cylindrical (i.e., semi-circular in cross-section) as illustrated.

The insert member 930 is removably retained in the channel 924A by the retention tab 948A and the notch 952.

According to some embodiments, the insert member 930 is pre-installed in the channel 924A in the factory. However, according to some embodiments, the insert member 930 may be installed in the channel 924A in the field by an installer, for example.

The insert member channel 936 is sized and shaped to cradle an elongate conductor (e.g., the conductor 14) and hold the conductor in position during assembly of the connector assembly 100. The channel 936 is smaller than (and may be shaped differently than) the channel 924A to accommodate smaller sized elongate conductors than the channel 924A. The channel 936 includes an open side that receives the elongate conductor and exposes at least a circumferential portion of the elongate conductor. The open side of the channel 936 lies along the mating interface and generally faces toward the sleeve member channel 114A in use.

In use, the insert member 930 is seated in the wedge member channel 924A with the retention tab 948A seated in the retention notch 952. The subassembly including the wedge member 920 and the insert member 930 is forced into the sleeve member (e.g., sleeve member 110) to clamp the conductor 14 between the sleeve member 110 and the wedge member 920 as described above. The conductor 14 is received in and engages the conductor channel 936 of the insert member 930 to capture the conductor 14 between the wedge member 920 and the sleeve member 110.

The retention tab 948A and the retention notch 952 cooperate to prevent or inhibit axial displacement of the insert member 930 in the sleeve member 110 when the wedge member 920 is forced.

The wedge member 920 can be used with or without the insert member 930, depending on the size of the conductor to be connected.

The insert member 930 serves as a spacer that reduces the effective depth, volume and/or size of the wedge member channel 924A within which it is mounted. The insert member 930 partially fills the void of the wedge member channel 924A so that the distance between the sleeve member engagement surface 114C (FIG. 4) and the opposing abutment is reduced. The channels 924A and 936 are different from one another in cross-sectional size and/or shape so that they are each sized or configured to accommodate a different size elongate conductor in a different range of diameters. In some embodiments, the depth of the channel 936 is less than the depth of the channel 924A. In some embodiments, the radius of curvature of the channel 936 is less than that of the channel 924A. In some embodiments, the width of the insert member channel 936 is less than the width of the wedge member channel 924A.

In some embodiments, the installer determines the size (e.g., the diameter or gauge) of the elongate conductor 12 and then determines which of the channels 924A, 936 is of the appropriate corresponding or prescribed channel size to receive an elongate conductor of this size. If the channel 936 is selected, the insert member 930 is mounted in the wedge member channel 924A (or is left in the channel 924A if the insert member 930 is already mounted therein) to form a sleeve subassembly, and the conductor 12 is then mounted in the channel 936. If the channel 924A is selected, the insert member 930 is not mounted in the channel 924A (or is removed from the channel 924A if pre-installed) and the conductor 12 is mounted directly in the channel 924A.

The wedge member 920 can be used with insert members 930 having different dimensions, depending on the dimensions of the conductor 14 to be connected. For example, the user may be supplied with a plurality of insert members 930 of different sizes. If a larger conductor is being connected, the installer can select and use an insert member 930 from the plurality of insert members having a relatively large dimensioned (e.g., depth and width) conductor channel 936. If a smaller conductor is being connected, the installer can select and use an insert member 930 having a relatively small dimensioned conductor channel 936.

Figure 34:
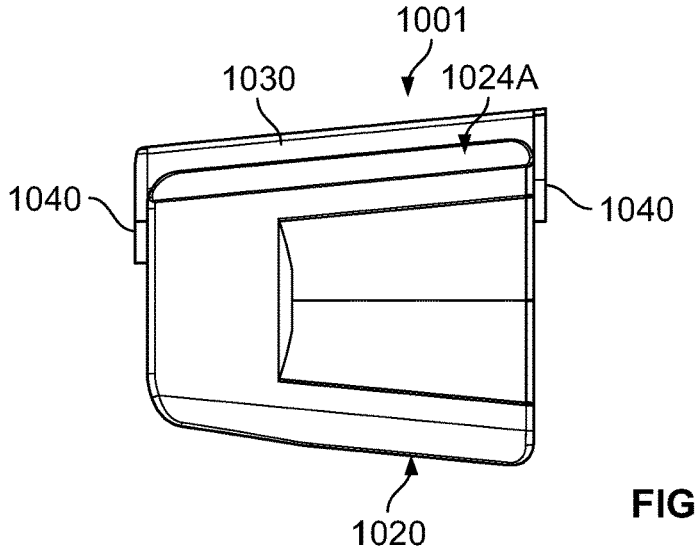
FIG. 34 is a side view of a wedge connector system according to further embodiments.
Figure 35:
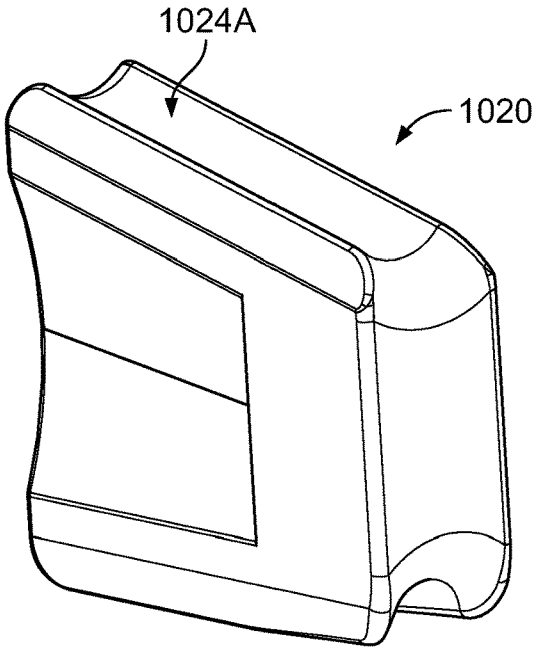
FIG. 35 is a front perspective view of a wedge member forming a part of the wedge connector system of FIG. 34.
Figure 36:
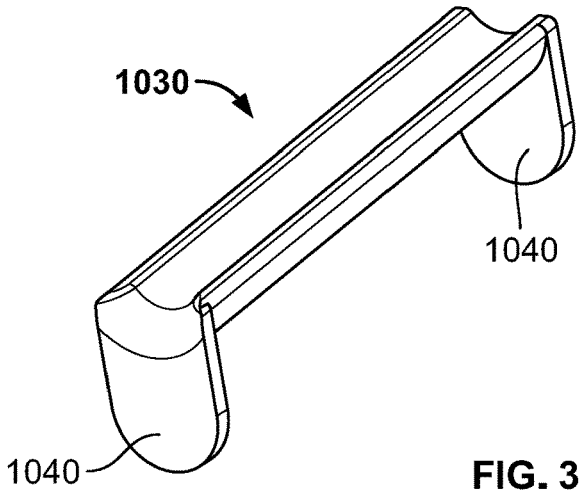
FIG. 36 is a front perspective view of an insert member forming a part of the wedge connector system of FIG. 34.

With reference to FIGS. 34-36, a wedge connector system 1001 according to further embodiments of the invention is shown therein. The wedge connector system 1001 includes a wedge member 1020, an insert member 1030, and the sleeve member 110 (FIG. 2). The connector system 1001 corresponds to and may be used in the same manner as the connector assembly 901, except as discussed below.

The wedge member 1020 is constructed in the same manner as the wedge member 120 discussed above.

The insert member 1030 is constructed in the same manner as the insert member 930, except that the insert member 1030 includes opposed, integral retention tabs 1040 that depend from respective ones of the end edges in place of the retention tab 948A.

The insert member 1030 is removably retained in the channel 1024A by the retention tabs 1040 as shown in FIG. 34. The retention tabs 1040 overlap the opposed end faces of the wedge member 1020. The retention tabs 1040 may be sized or shaped to create an interference fit between the retention tabs 1040 and the end faces of the wedge member 1020 sufficient to retain the insert member 1030 in the channel 1024A unless and until a deliberate removal force is applied to the insert member 1030. In other embodiments, the retention tabs 1040 may be configured so that the insert member 1030 fits loosely in the wedge member channel 1024A.

In use, the subassembly including the wedge member 1020 and the insert member 1030 is forced into the sleeve member (e.g., sleeve member 110) to clamp the conductor 14 between the sleeve member 110 and the wedge member 1020 as described above. The retention tabs 1040 to prevent or inhibit axial displacement of the insert member 1030 in the wedge member 1010.

The wedge member 1020 can be used with or without the insert member 1030, depending on the size of the conductor to be connected.

With reference to FIGS. 37-41, a wedge connector system 1101 according to further embodiments of the invention is shown therein. The wedge connector system 1101 includes a wedge member 1120, an insert member 1130, and the sleeve member 110 (FIG. 2). The connector system 1101 corresponds to and may be used in the same manner as the connector assembly 901, except as discussed below.

The wedge member 1120 is constructed in the same manner as the wedge member 120 or 920, except as follows. The wedge member 1120 includes a retention notch 1152 defined in its front end and elongate, axially extending retention rail 1154 defined on one lateral edge.

The insert member 1130 is constructed in the same manner as the insert member 930, except as follows. The insert member 1130 has a modified retention tab 1148A shaped to fit in the retention notch 1152. The insert member

1130 also has a retention slot 1148B defined in its inner surface configured to receive the retention rail 1154.

Figure 37:
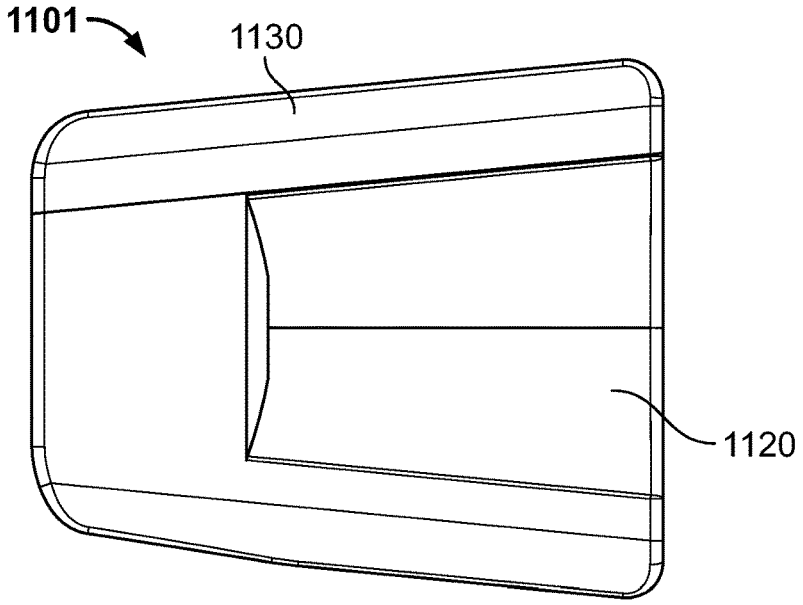
FIG. 37 is a side view of a wedge connector system according to further embodiments.
Figure 38:
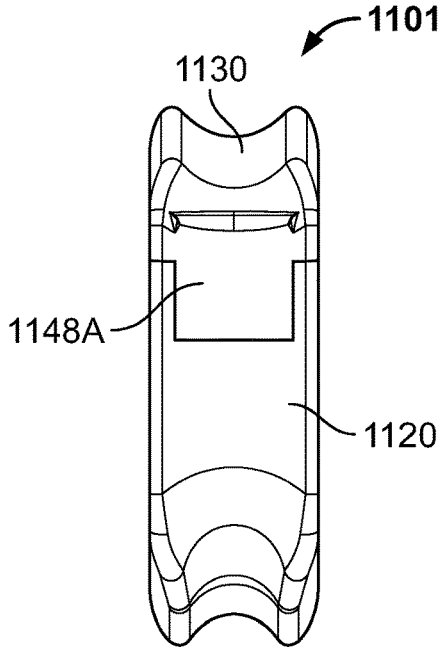
FIG. 38 is a front end view of the wedge connector system of FIG. 37.
Figure 39:
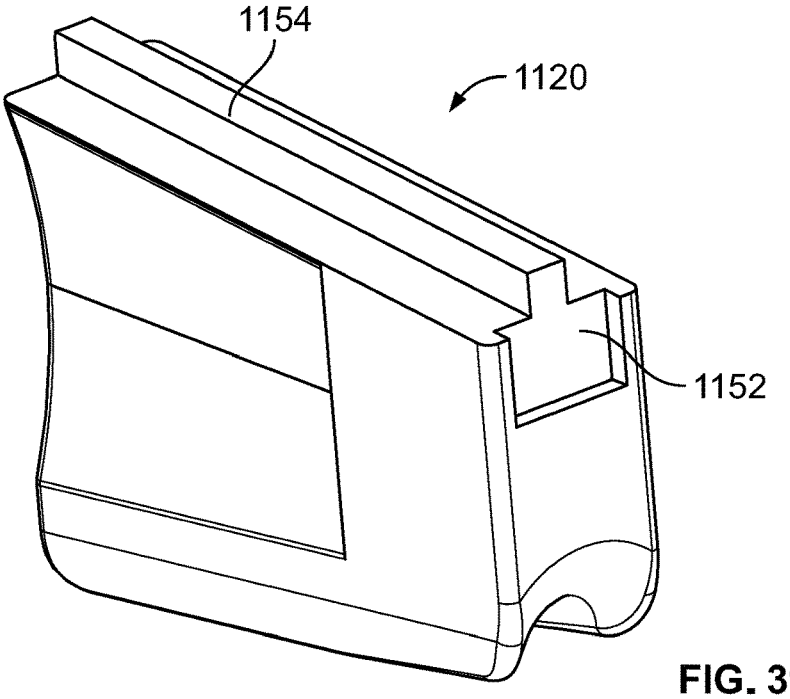
FIG. 39 is a front perspective view of a wedge member forming a part of the wedge connector system of FIG. 37.
Figure 40:
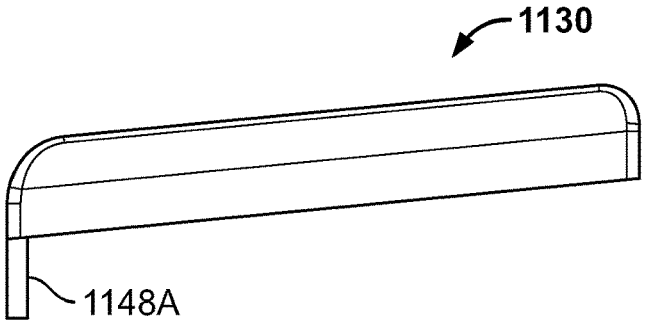
FIG. 40 is a side view of an insert member forming a part of the wedge connector system of FIG. 37.
Figure 41:
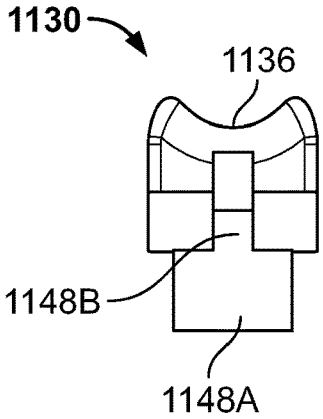
FIG. 41 is a rear end view of the insert member of FIG. 40.

In use, the insert member 1130 is seated on the wedge member 1120 with the retention tab 1148A seated in the retention notch 1152 and the retention rail 1154 seated in the retention slot 1148B as shown in FIGS. 37 and 38. The subassembly including the wedge member 1120 and the insert member 1130 is forced into the sleeve member (e.g., sleeve member 110) to clamp the conductor 14 between the sleeve member 1110 and the wedge member 1120 as described above. The conductor 14 is received in and engages the conductor channel 1124A of the insert member 1130 to capture the conductor 14 between the wedge member 1120 and the sleeve member 110.

The retention tab 1148A, the retention notch 1152, the retention rail 1154, and the retention slot 1148B cooperate to prevent or inhibit axial displacement of the insert member 1130 in the wedge member 1110 when the wedge member 1120 is forced into the sleeve member 110.

The wedge member 1120 can be used with insert members 1130 having different dimensions, depending on the dimensions of the conductor 14 to be connected. For example, the user may be supplied with a plurality of insert members 1130 of different sizes. If a larger conductor is being connected, the installer can select and use an insert member 1130 from the plurality of insert members having a relatively large dimensioned (e.g., depth and width) conductor channel 1136 and, if a smaller conductor is being connected, the installer can select and use an insert member 1130 having a relatively small dimensioned conductor channel 1136.

Figure 42:
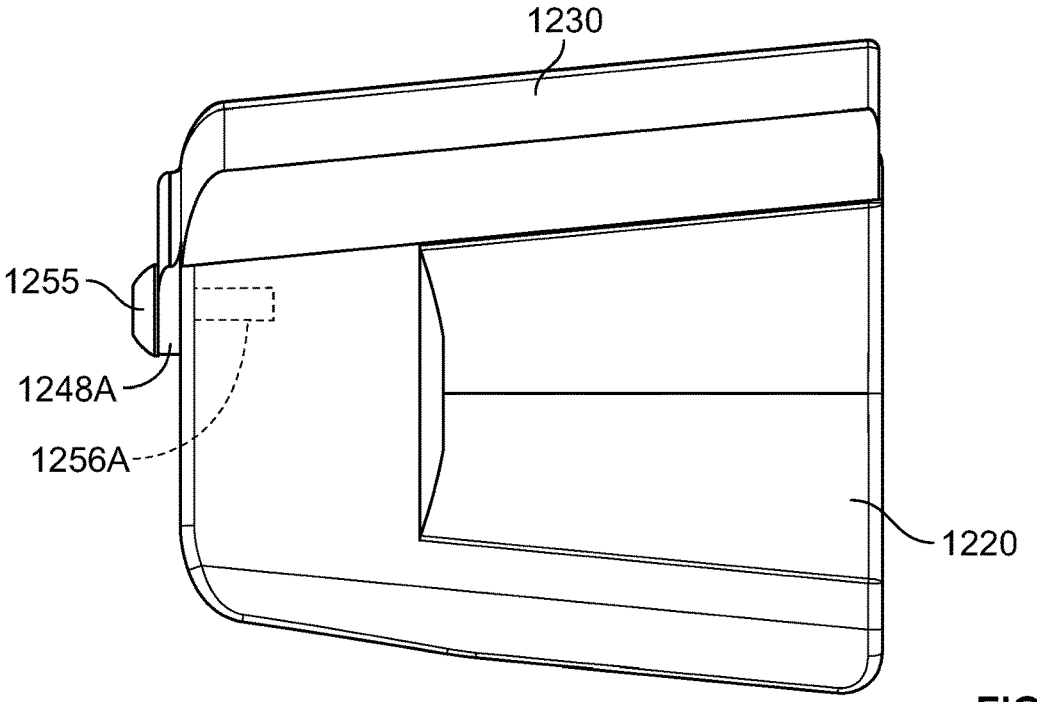
FIG. 42 is a side view of a wedge connector system according to further embodiments.
Figure 43:
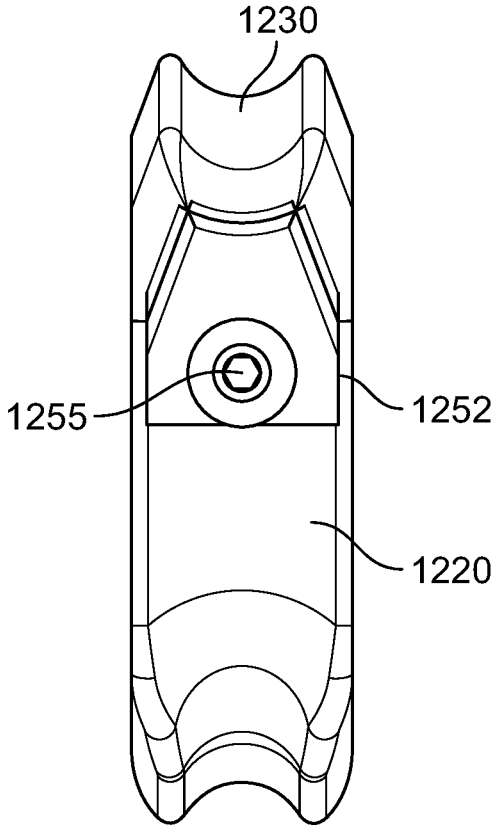
FIG. 43 is a front end view of the wedge connector system of FIG. 42.
Figure 44:
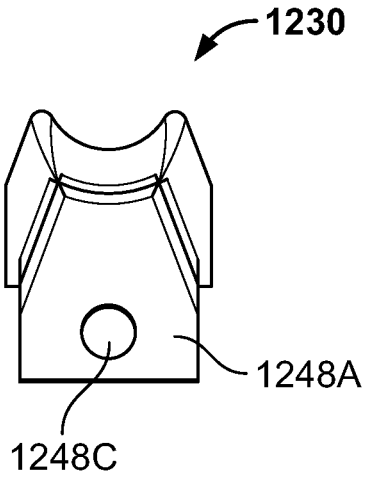
FIG. 44 is a front end view of an insert member forming a part of the wedge connector system of FIG. 42.

With reference to FIGS. 42-44, a wedge connector system 1201 according to further embodiments of the invention is shown therein. The wedge connector system 1201 includes a wedge member 1220, an insert member 1230, a screw fastener 1255, and the sleeve member 110 (FIG. 2). The connector system 1201 corresponds to and may be used in the same manner as the connector assembly 1101, except as discussed below.

The wedge member 1220 is constructed in the same manner as the wedge member 1120, except as follows. The wedge member 1220 includes a threaded fastener bore 1256A defined in its front end in the retention notch 1252.

The insert member 1230 is constructed in the same manner as the insert member 1130, except as follows. The insert member 1230 further includes a fastener hole 1248C defined in its retention tab 1248A.

In use, the insert member 1230 is mounted on the wedge member 1220 in the same manner as described for the insert member 1130, except that the insert member 1230 is further secured by installing the screw fastener 1255 through the hole and into the bore 1256A, as shown in FIGS. 42 and 43. The connector system 1201 may thereafter be used in the same manner as the connector system 1101 to form a connection.

Insert members 1230 of different sizes and shapes can be interchangeably installed and used on the wedge member 1120, as discussed with regard to the connector system 1101.

Components and aspects of the connector systems 101-1201 and connectors described herein can be used in any other suitable combinations. For example, any of the insert members or insert member assemblies 130, 231, 330, 430, 531, 630, 730, 831 can be used in place of any of the others with suitable modification to the associated sleeve member, if needed. Each of the insert members can be modified to include a smooth, ribbed, and/or raised conductor channel. Each embodiment can be employed with an integral bolt-drive as described with regard to the connector system 801 or a non-bolt drive architecture as described with regard to the connector system 100 (e.g., driven by a powder actuated tool).

Figure 5:
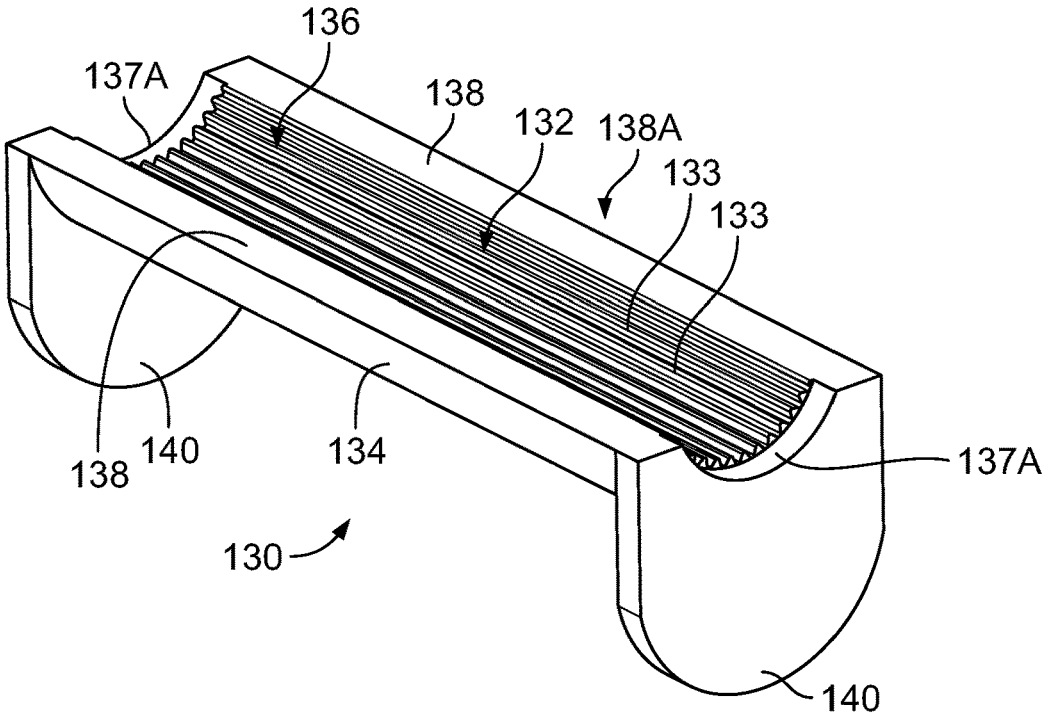
FIG. 5 is a perspective view of an insert member forming a part of the wedge connector assembly of FIG. 1.
Figure 6:
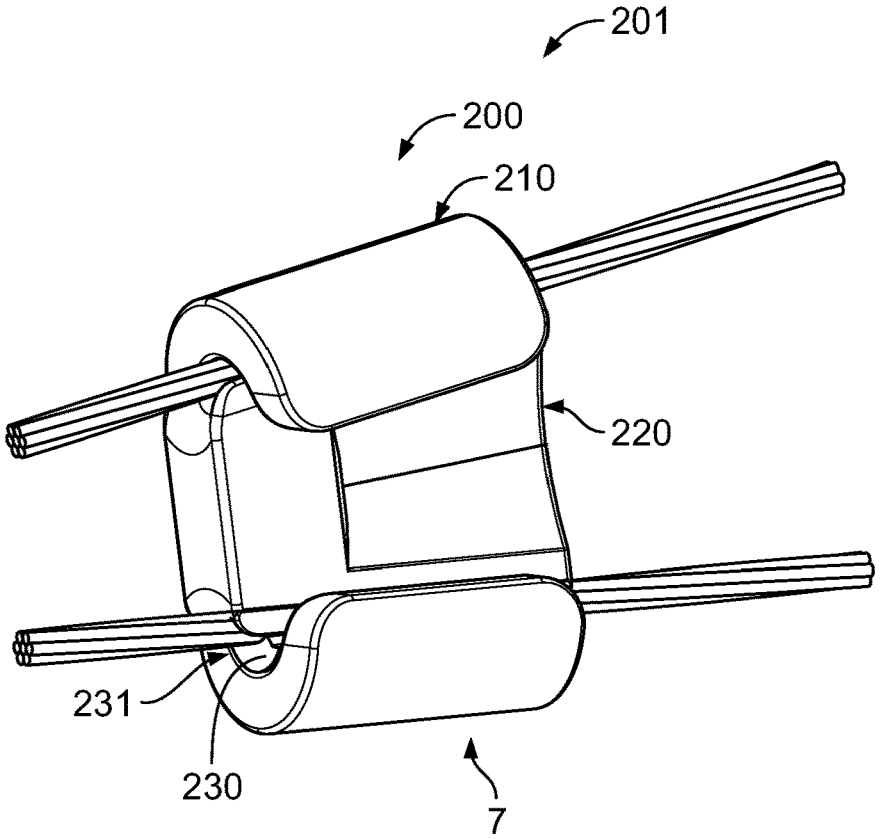
FIG. 6 is a front perspective view of a wedge connector system, and a wedge connector assembly and a connection formed thereby, according to further embodiments.
Figure 7:
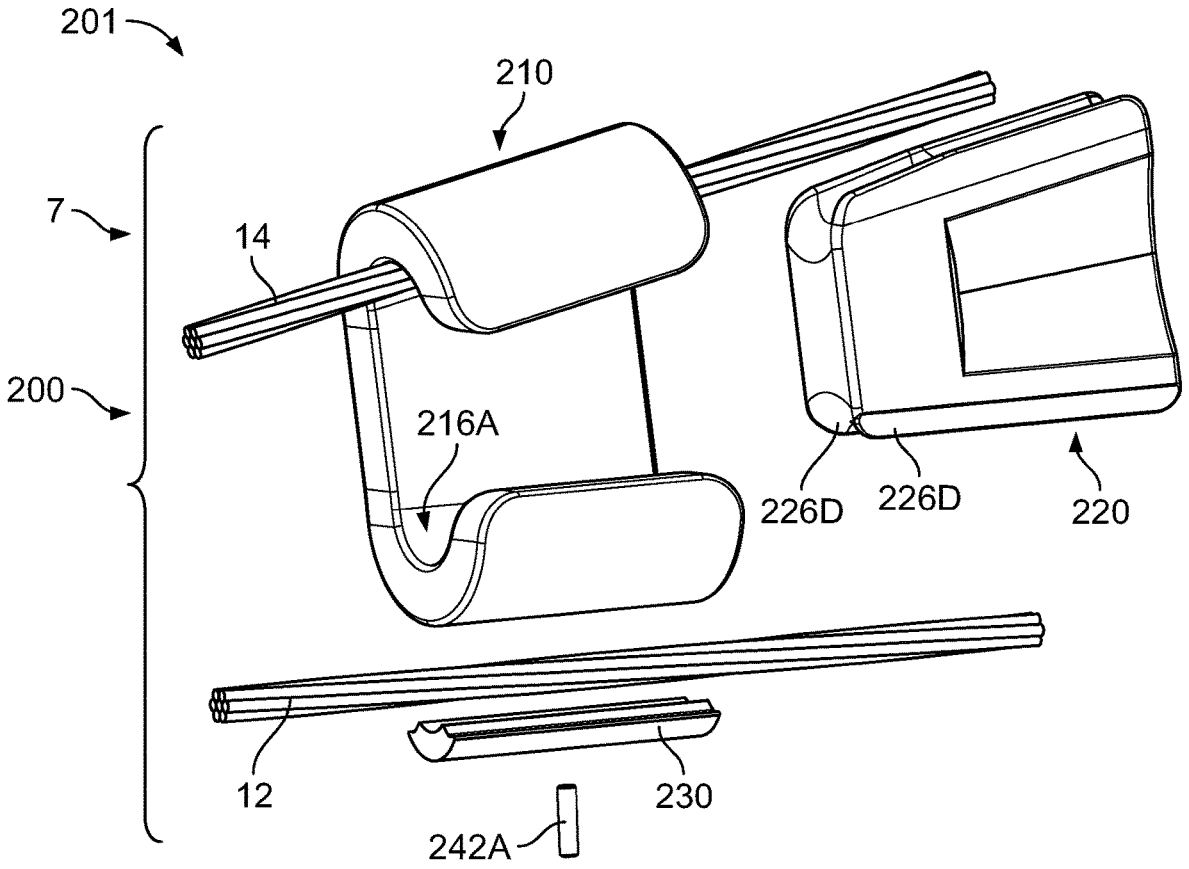
FIG. 7 is an exploded, front perspective view of the connection of FIG. 6.
Figure 8:
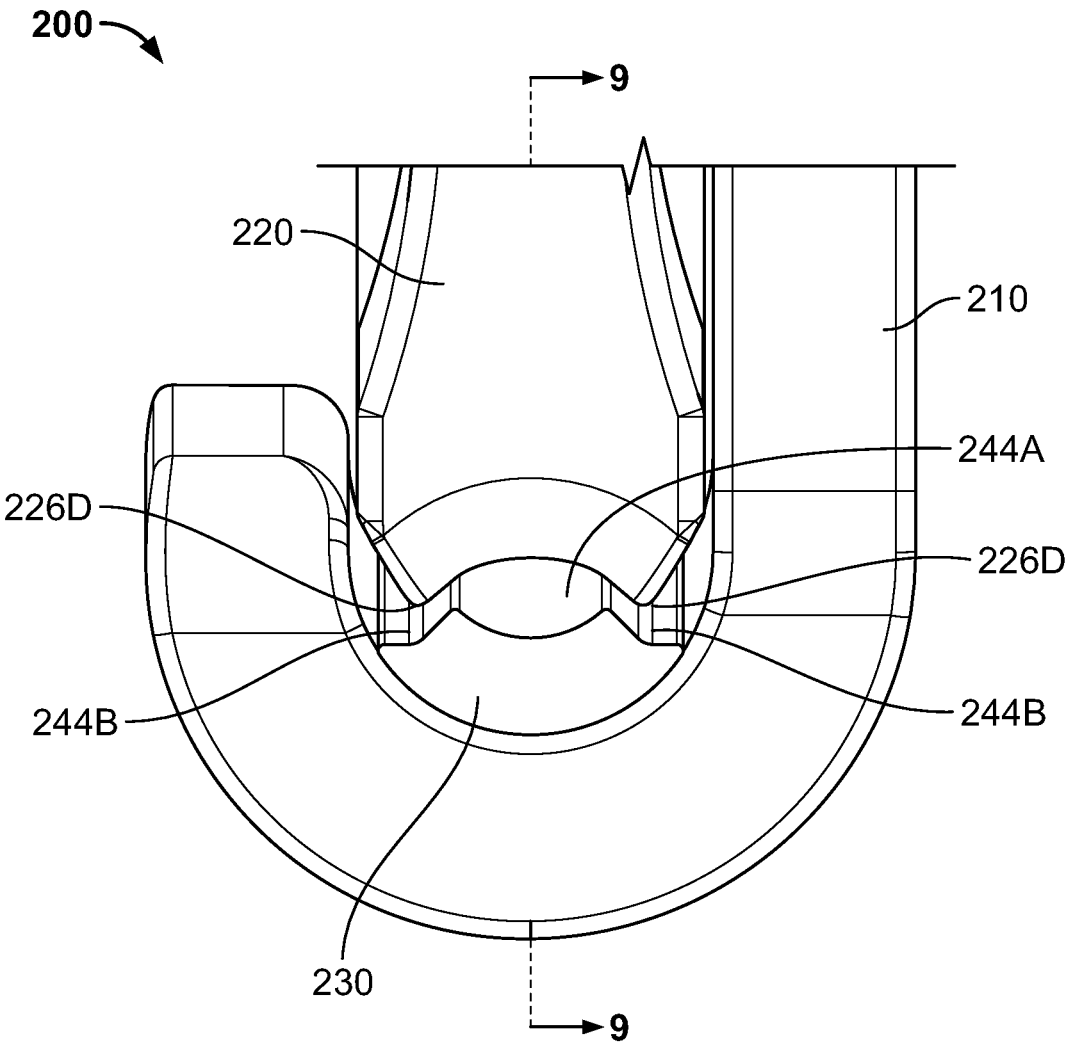
FIG. 8 is an enlarged, fragmentary front end view of the wedge connector assembly of FIG. 6.
Figure 9:
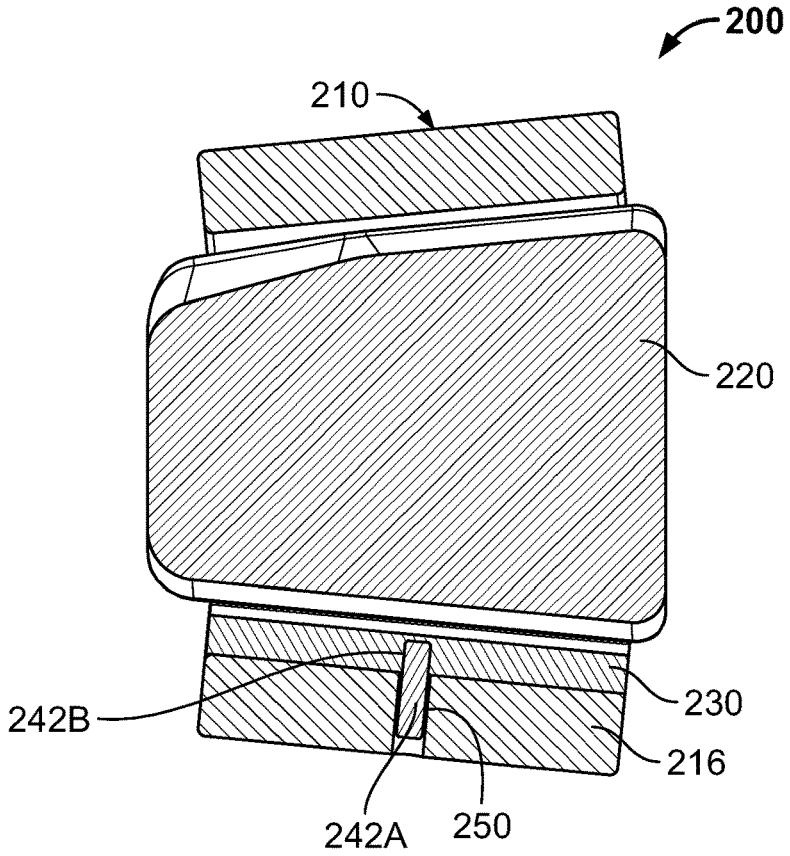
FIG. 9 is a cross-sectional view of the wedge connector assembly of FIG. 6 taken along the line 9-9 of FIG. 8.
Figure 10:
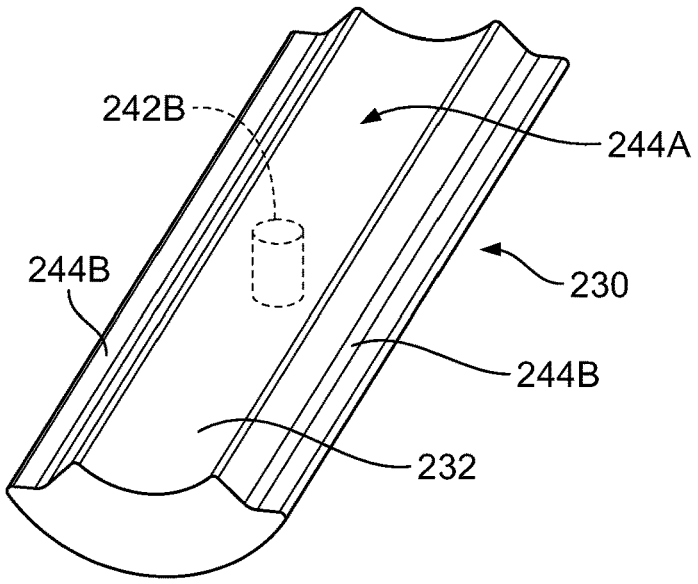
FIG. 10 is a perspective view of an insert member forming a part of the wedge connector assembly of FIG. 6.

While elongate ribs that extend parallel to the lengthwise axis of the connector are shown and described (e.g., the ribs 133; FIG. 5), contact ribs of other shapes and configurations may be provided. For example, the ribs may be linear ribs that extend transverse (e.g., perpendicular or laterally) to the connector lengthwise axis, or nonlinear ribs (e.g., spiral), or a combination of different patterns.

Connector systems as disclosed herein including insert members can provide an economical, efficient, and user friendly connector solution. The connector systems can effectively accommodate a broadened range of conductor sizes with reduced part number and inventory requirements.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A wedge connector system for connecting first and second elongate electrical conductors, the wedge connector system comprising:

a C-shaped sleeve member defining a sleeve cavity and opposed first and second sleeve channels on either side of the sleeve cavity;

a wedge member including a wedge body having first and second opposed wedge side walls; and an insert member configured to be selectively mounted in the first sleeve channel and defining an insert member channel to receive the first conductor when the insert member is mounted in the first sleeve channel;

wherein the sleeve member and the wedge member are configured to capture the first and second conductors such that:

the first conductor is received in the insert member channel and captured between the sleeve member and the first wedge side wall; and the second conductor is captured between the sleeve member and the second wedge side wall; and wherein:

the insert member includes axially extending relief channels located on laterally-opposed sides of the insert member channel; and the relief channels are configured to receive outer edge portions of the wedge member.

2. The wedge connector system of claim 1 wherein the first sleeve channel and the insert member channel are different sizes from one another.

3. The wedge connector system of claim 1 wherein the first sleeve channel is deeper than the insert member channel.

4. The wedge connector system of claim 1 wherein the insert member is electrically-conductive.

5. The wedge connector system of claim 1 wherein the insert member includes at least one integral retention tab that engages the sleeve member to limit relative axial displacement between the insert member and the sleeve member when the wedge member is driven axially into the sleeve member.

6. The wedge connector system of claim 5 wherein the insert member includes axially-opposed first and second integral retention tabs configured to abut opposed axial ends of the sleeve member.

7. The wedge connector system of claim 5 wherein:

the sleeve member includes an integral retention slot; and the retention tab is seated in the retention slot to limit relative axial displacement between the insert member and the sleeve member when the wedge member is driven axially into the sleeve member.

8. The wedge connector system of claim 5 wherein:

the sleeve member includes integral, axially-opposed first and second retention slots; and the insert member includes integral, axially-opposed first and second retention tabs seated in the first and second retention slots, respectively, to limit relative axial displacement between the insert member and the sleeve member when the wedge member is driven axially into the sleeve member.

9. The wedge connector system of claim 1 wherein:

the sleeve member includes an integral, elongate retention slot; and the insert member includes an integral, elongate flange seated in the elongate retention slot to limit relative axial displacement between the insert member and the sleeve member when the wedge member is driven axially into the sleeve member.

10. The wedge connector system of claim 1 wherein:

the sleeve member includes integral, laterally-opposed, axially-extending, elongate first and second retention slots; and the insert member includes integral, laterally-opposed, axially-extending, elongate first and second retention flanges; and the first and second flanges are seated in the first and second retention slots, respectively, to limit relative axial displacement between the insert member and the sleeve member when the wedge member is driven axially into the sleeve member.

11. The wedge connector system of claim 1 including a fastener extending through the sleeve and into the insert member to limit relative axial displacement between the insert member and the sleeve member when the wedge member is driven axially into the sleeve member.

12. The wedge connector system of claim 1 including an integral drive mechanism operable to forcibly drive the wedge member axially into the sleeve member to capture the first conductor in the insert member channel between the sleeve member and the first wedge side wall.

13. The wedge connector system of claim 1 wherein the insert member is formed of metal.

14. A method for connecting first and second elongate electrical conductors, the method comprising:

providing a wedge connector system including:

a C-shaped sleeve member defining a sleeve cavity and opposed first and second sleeve channels on either side of the sleeve cavity;

a wedge member including a wedge body having first and second opposed wedge side walls; and an insert member configured to be selectively mounted in the first sleeve channel and defining an insert member channel to receive the first conductor when the insert member is mounted in the first sleeve channel;

placing the first conductor in the insert member channel with the insert member mounted in the first channel; and thereafter axially displacing the sleeve member and wedge member relative to one another to capture the first and second conductors such that:

the first conductor is received in the insert member channel and captured between the sleeve member and the first wedge side wall; and the second conductor is captured between the sleeve member and the second wedge side wall;

wherein:

the insert member includes axially-extending relief channels located on laterally-opposed sides of the insert member channel; and the relief channels are configured to receive outer edge portions of the wedge member.

15. The method of claim 14 wherein the first channel and the insert member channel are of different sizes from one another, the method including:

determining the size of the first conductor;

determining that the insert member corresponds to the determined size of the first conductor; and thereafter mounting the insert member in the first channel.

16. The method of claim 14 wherein the first sleeve channel and the insert member channel are different sizes from one another.

17. The method of claim 14 wherein the insert member is formed of metal.

18. The method of claim 14 wherein the insert member includes at least one integral retention tab that engages the sleeve member to limit relative axial displacement between the insert member and the sleeve member when the wedge member is driven axially into the sleeve member.

19. The method of claim 14 wherein:

the sleeve member includes an integral, elongate retention slot; and the insert member includes an integral, elongate flange seated in the elongate retention slot to limit relative axial displacement between the insert member and the sleeve member when the wedge member is driven axially into the sleeve member.

20. The method of claim 14 including a fastener extending through the sleeve and into the insert member to limit relative axial displacement between the insert member and the sleeve member when the wedge member is driven axially into the sleeve member.

21. The method of claim 14 including an integral drive mechanism operable to forcibly drive the wedge member axially into the sleeve member to capture the first conductor in the insert member channel between the sleeve member and the first wedge side wall.

* * * * *